US008287229B2

(12) United States Patent
Pickard

(10) Patent No.: US 8,287,229 B2
(45) Date of Patent: Oct. 16, 2012

(54) ROTOR AND NOZZLE ASSEMBLY FOR A RADIAL TURBINE AND METHOD OF OPERATION

(75) Inventor: John D. Pickard, Louisville, KY (US)

(73) Assignee: Cambridge Research and Development Limited, St. Neots (GB)

( * ) Notice: Subject to any disclaimer, the term of this patent is extended or adjusted under 35 U.S.C. 154(b) by 0 days.

(21) Appl. No.: 13/414,103

(22) Filed: Mar. 7, 2012

(65) Prior Publication Data

US 2012/0223526 A1 Sep. 6, 2012

Related U.S. Application Data

(62) Division of application No. 12/282,931, filed as application No. PCT/GB2007/000879 on Mar. 14, 2007, now Pat. No. 8,162,588.

(60) Provisional application No. 60/782,126, filed on Mar. 14, 2006.

(51) Int. Cl.
*F01D 9/00* (2006.01)

(52) U.S. Cl. ..... 415/1

(58) Field of Classification Search ..... 415/1, 191, 415/80, 204; 60/624, 185; 228/119
See application file for complete search history.

(56) References Cited

U.S. PATENT DOCUMENTS

| | | | | |
|---|---|---|---|---|
| 1,546,744 | A * | 7/1925 | O'Neill | 415/187 |
| 1,676,806 | A | 7/1928 | Smalley | |
| 1,882,630 | A | 10/1932 | Jarvis | |
| 2,768,808 | A * | 10/1956 | Worre | 415/80 |
| 3,642,379 | A | 2/1972 | Swearingen | |
| 3,652,176 | A * | 3/1972 | Walsh | 415/9 |
| 3,690,784 | A * | 9/1972 | Farrow | 415/54.1 |
| 4,177,638 | A | 12/1979 | Wood | |
| 4,186,555 | A | 2/1980 | Fauconnet | |
| 4,197,051 | A | 4/1980 | Egli et al. | |
| 4,281,511 | A | 8/1981 | Neale | |
| 4,302,147 | A * | 11/1981 | Cherubim | 415/92 |
| 4,325,672 | A | 4/1982 | Sixsmith et al. | |
| 4,435,121 | A * | 3/1984 | Wosika | 415/198.1 |
| 4,586,336 | A * | 5/1986 | Horler | 60/602 |
| 4,923,364 | A | 5/1990 | Nilsen et al. | |
| 5,143,511 | A | 9/1992 | Verneau et al. | |
| 5,236,349 | A | 8/1993 | Fabris | |

(Continued)

FOREIGN PATENT DOCUMENTS

| | | |
|---|---|---|
| DE | 532 307 | 9/1931 |

(Continued)

OTHER PUBLICATIONS

Calvert. "Turbines". http://www.du.edu/~jcalvert/tech/fluids/turbine.htm. Downloaded Jan. 22, 2007. 9 pages.

(Continued)

*Primary Examiner* — Alexander Gilman
(74) *Attorney, Agent, or Firm* — Hamre, Schumann, Mueller & Larson, P.C.

(57) ABSTRACT

A rotor for a radial flow turbine has an impulse chamber (51) having an inlet defined in a circumferential surface of the rotor and a reaction chamber (62) having an outlet defined in the circumferential surface of the rotor. The impulse chamber is in fluid communication with the reaction chamber, and the reaction chamber outlet is axially displaced from the impulse chamber inlet.

11 Claims, 36 Drawing Sheets

U.S. PATENT DOCUMENTS

Figure 1:
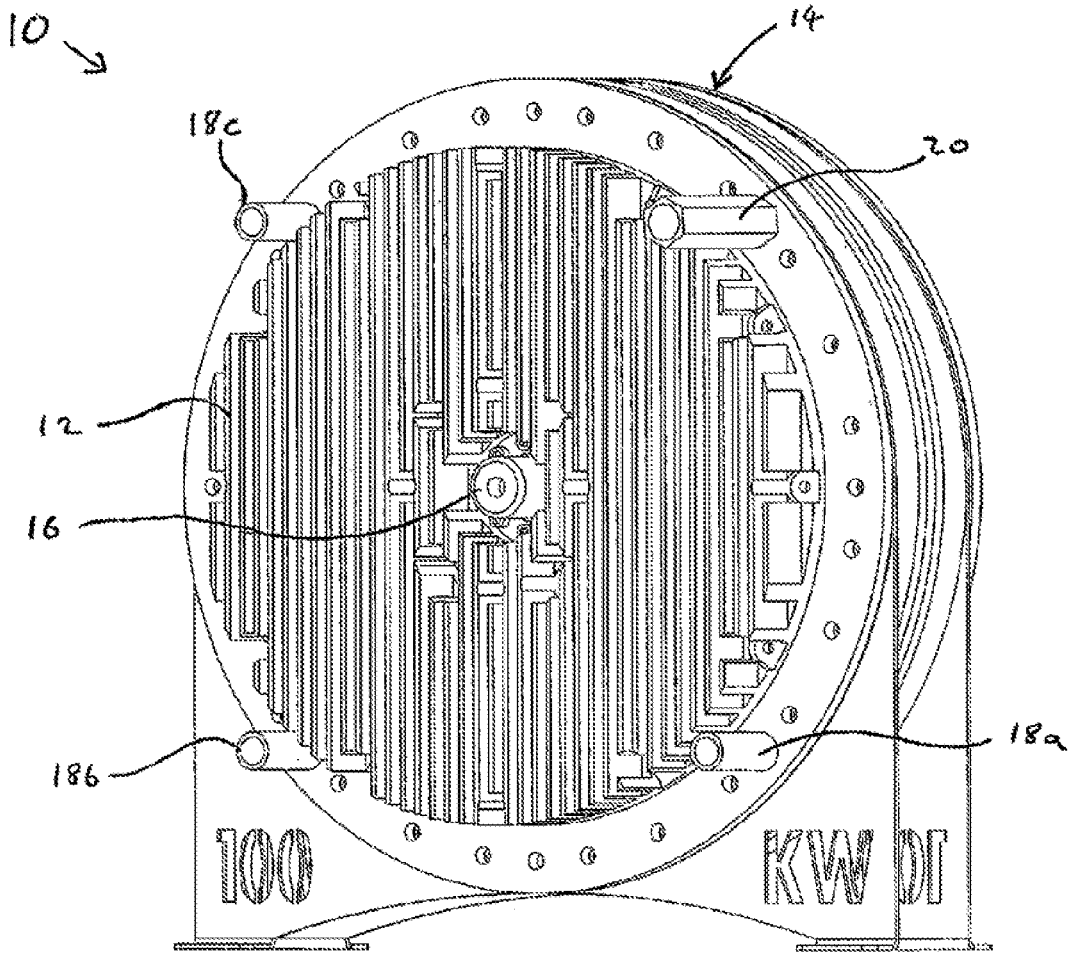

| | | | | |
|---|---|---|---|---|
| 5,259,727 | A | 11/1993 | Quinn | |
| 5,392,513 | A * | 2/1995 | Mazzola et al. | 29/889.1 |
| 5,513,950 | A | 5/1996 | Yu | |
| 5,899,673 | A | 5/1999 | Bosley et al. | |
| 5,906,473 | A * | 5/1999 | Sexton et al. | 415/173.2 |
| 6,468,051 | B2 | 10/2002 | Lampe et al. | |
| 6,476,634 | B1 | 11/2002 | Bilski | |
| 6,494,673 | B2 | 12/2002 | Choy et al. | |
| 6,607,351 | B1 | 8/2003 | Hablanian | |
| 6,626,641 | B1 | 9/2003 | Burns et al. | |
| 6,767,179 | B2 | 7/2004 | Kusagaya et al. | |
| 7,331,754 | B2 * | 2/2008 | O'Clair et al. | 415/1 |
| 8,051,664 | B2 * | 11/2011 | Fish | 60/800 |
| 2003/0231952 | A1 | 12/2003 | Moss | |

FOREIGN PATENT DOCUMENTS

| | | |
|---|---|---|
| DE | 962 762 | 4/1957 |
| DE | 31 19 068 | 11/1982 |
| DE | 44 40 241 | 3/1996 |
| DE | 299 02 285 | 4/1999 |
| GB | 2 405 448 | 3/2005 |
| WO | WO 2004/025085 | 3/2004 |

OTHER PUBLICATIONS

"Banki Turbine". http://en/wikipedia.org/wiki/banki_turbine. Downloaded Jan. 22, 2007. 1 page.

* cited by examiner

ROTOR AND NOZZLE ASSEMBLY FOR A RADIAL TURBINE AND METHOD OF OPERATION

This application is a Division of U.S. Ser. No. 12/282,931, filed Feb. 10, 2009 now U.S. Pat. No. 8,162,588, which is a National Stage Application of PCT/GB2007/000879, filed Mar. 14, 2007, which is a non-provisional of U.S. Ser. No. 60/782,129, filed Mar. 14, 2006, which applications are incorporated herein by reference.

FIELD OF THE INVENTION

The present invention relates to turbine generators and components of turbine generators.

BACKGROUND TO THE INVENTION

In the modern, environmentally-conscious, world there is a drive to identify applications or processes that waste energy and, if possible, reclaim some of that waste energy. Thus, there is a strong interest in systems that can recover energy from waste heat by using that heat efficiently to generate electricity.

Examples of applications of where "Waste Heat Recovery" could be of interest include:

1. Vehicular engines, including: any engine that burns fuel and gives off waste heat such as: large truck engines, car engines, marine boat engines including ocean going cargo and passenger ships.
2. Stationary industrial engines, including: pipeline compressor and pumping engines. Industrial power plants also use large engines.
3. Large building boiler rooms, including: hotels, shopping malls, restaurants, laundries, hospitals, convention centres, and large retail outlets like Wal*Mart®, Sears®, Home Depot®, and others.
4. Solar applications. For example in some climates, for example in the Southern states of the USA, there is a great abundance of heat available from sunlight. A solar hot box containing heat exchangers can provide energy to run a turbine generator, and power can be generated and used on-site. Public utilities need such distributed generation systems as the demand on the current grid is growing faster than utility companies can create new sources of power. A roof top power system that is owned and controlled by a state or regional utility may be able to meet new demand without the requirement for new coal or gas fired generating plants. All of this new power is green-energy and may qualify for a world wide market in carbon credits.
5. Off Grid Solar Applications. Often there is a requirement for electric power in remote locations that are not being serviced by the electric power grid. A turbine generator according to the present invention could be sized to meet the local requirements.

Another application could be the generation of electricity for pumping of water for agricultural use. The cost of fossil fuels such as diesel is high and therefore the use of solar heat, for example gathered by a hot box facing the sun, may be advantageous in irrigation applications.

One way to use heat, for example waste heat, to generate power is to use that heat to drive a turbine. It is an aim of this invention to provide a turbine generator, and components for use in a turbine generator, that may have an advantageous application in the recovery of waste heat.

SUMMARY OF INVENTION

The invention provides, in its various aspects, a rotor for a radial flow turbine, a nozzle ring assembly, a method of driving a rotor for a radial flow turbine, a radial flow turbine, a system for generating electricity from waste heat, and a location disk for a turbine generator according to the appended independent claims, to which reference should now be made. Preferred or advantageous features of the invention are defined in dependent sub-claims.

In a first aspect, the invention may thus provide a rotor for a radial-flow turbine, the rotor comprising; an impulse chamber, having an inlet defined in a circumferential surface of the rotor, and a reaction chamber, having an outlet defined in the circumferential surface of the rotor, in which the impulse chamber is in fluid communication with the reaction chamber and the impulse chamber inlet is axially displaced from the associated reaction chamber outlet.

A radial-flow turbine is driven by a jet of fluid impinging on a rotor in a substantially radial direction. Thus, the impulse chamber of the rotor may be shaped such that a jet of fluid directed through the inlet interacts with the impulse chamber and imparts a first force to turn the rotor. The impulse chamber may, thus, act as an impulse bucket.

The rotor of the first aspect is arranged such that both the inlet and the outlet are defined in a circumferential surface of the rotor. Advantageously, the reaction chamber may be shaped such that it expels a jet of fluid and may thereby impart a second force to turn the rotor.

Advantageously, the impulse chamber may be in fluid communication with the reaction chamber such that fluid directed through the inlet of the impulse chamber passes through the impulse chamber, is directed into the reaction chamber, and is expelled through the outlet of the reaction chamber. Thus, the inlet may accept a jet of driving fluid and this fluid may be directed through the is impulse chamber and exhausted through the outlet of the reaction chamber.

Preferably, the rotor comprises a plurality of impulse chambers with each impulse chamber having an associated reaction chamber. Where there are a plurality of impulse chambers, the impulse chamber inlets are preferably disposed in a first plane around the circumferential surface of the rotor. The reaction chamber outlets may be disposed in a second plane around the circumferential surface of the rotor, the second plane being axially displaced from the first plane. Thus, the inlet and the outlet may be in different planes around the circumferential surface of the rotor.

Where a plurality of impulse chambers is distributed circumferentially around the rotor each impulse chamber inlet is spaced from a neighbouring inlet by a number of degrees. Where there are a large number of impulse chambers it is preferable that the chamber inlets are evenly distributed around the circumference of the rotor, and thus for example a rotor having 60 impulse chambers preferably has each impulse chamber inlet spaced at 6 degrees to the next inlet around the circumference of the rotor. Likewise, if the rotor has 360 impulse chambers, preferably each impulse chamber inlet is distributed at 1 degree from the next inlet around the circumference of the rotor.

Each impulse chamber is associated with a reaction chamber and the spacing of the outlets is as described above in relation to the impulse chamber inlets.

Advantageously, the or each impulse chamber inlet may be circumferentially spaced from its associated reaction chamber outlet by less than 20 degrees, or more preferably by less than 15 degrees or still more preferably by less than 10 degrees. Where there are a large number of impulse chambers the spacing of the impulse chamber inlet from its associated reaction chamber may be less than 5 degrees.

Where there are a large number of impulse chambers, preferably each impulse chamber inlet is circumferentially spaced from its associated reaction chamber outlet by the same number of degrees that each impulse chamber inlet is spaced from its neighbouring impulse chamber inlet. Where incoming driving fluid is directed through the inlet and out through the outlet this fluid is turned within the rotor by almost 180 degrees such that it is exhausted in almost the opposite direction that it came in.

The rotor may, advantageously, comprise a passage or conduit for connecting each impulse chamber with its associated reaction chamber. Such a passage may advantageously provide an axial (axially-directed) ramp for the fluid where the impulse chamber and the reaction chamber lie in separate axially displaced planes.

Preferably the driving fluid is directed at the rotor at a small angle to the rotor's circumference; this angle may be selected to provide efficiency in turning the rotor. The inlet direction may be, for example, between 5 and 30 degrees from the tangent to the circumference of the rotor.

The outlet direction may also be described as being at a small angle to the circumference of the rotor. The outlet direction may be between 5 and 30 degrees from a tangent to the circumference of the rotor.

Both the inlet direction and the outlet direction may have a greater range and may be, for instance, between 3 and 45 degrees from a tangent to the circumference of the rotor.

Preferably the outlet direction (described as a tangent to the circumference of the rotor) is substantially opposite to the inlet direction. This, advantageously, may provide that any forces imparted on the rotor by the passage of fluid through the impulse chamber and the exhausting of fluid from the reaction chamber are applied to turn the rotor in the same direction.

The impulse chamber may deflect the incoming jet of driving fluid by between 90 and 145 degrees from its inlet direction. This change in direction may slow the incoming jet of fluid and thus cause momentum of the fluid to be transferred to the rotor to turn the rotor. The impulse chamber may thus act as an impulse is bucket and cause a first force, an impulse force, to turn the rotor. Preferably the impulse chamber deflects the jet of fluid by between 110 and 140 degrees from its inlet direction, particularly preferably between 115 and 135 degrees from its inlet direction and particularly preferably between 120 and 130 degrees from its inlet direction. Preferably the change in direction of the impulse chamber occurs in the same radial plane, i.e. without any axial deflection of the incoming fluid.

The reaction chamber may also deflect the fluid as it passes through the chamber to the outlet. Preferably the deflection of the fluid in the reaction chamber occurs in the same radial plane, i.e. without any axial deflection of the fluid.

Advantageously, the rotor may comprise a plurality of layers or plates. For example the rotor may comprise an impulse plate defining the impulse chamber and a reaction plate defining the reaction chamber, the impulse plate and the reaction plate being coupled together to form the rotor.

The rotor may additionally comprise a partition plate disposed between the impulse plate and the reaction plate, the partition plate having an opening that allows fluid communication between the impulse chamber and the reaction chamber. The partition plate may also form a portion of the wall of the impulse chamber and a portion of the wall of the reaction chamber.

An inlet cross section may be defined as a cross section of the inlet perpendicular to the inlet direction and an outlet cross section may be defined as a cross section of the outlet perpendicular to the outlet direction. Preferably, the inlet cross section has a greater area than the outlet cross-section. Particularly preferably, the inlet cross sectional area is approximately three times the outlet cross sectional area.

The inlet cross-section may be defined as the height of the impulse chamber (measured in a direction parallel to the rotor axis) at the inlet multiplied by the width of the impulse chamber (measured perpendicular to the inlet direction). The height of the impulse chamber at the inlet, for a rotor using a phase-change fluid as the driving fluid, is preferably between ¼" (0.64 cm) and 1" (2.54 cm). The width of the impulse chamber, for a rotor using a phase-change fluid as the driving fluid, is preferably between 0.05" and 0.2" (0.13 cm and 0.5 cm) particularly preferably between 0.1" and 0.15" (0.25 cm and 0.38 cm). Thus, the inlet cross-sectional area may be between 0.08 $cm^2$ and 1.27 $cm^2$.

Preferably, the height of the impulse chamber is about three times the height of the reaction chamber.

The rotor may be arranged to carry magnets. The motion of such magnets relative to opposing coils may enable the rotor to generate electricity. Advantageously the rotor may comprise a plurality of recesses for retaining magnets. Such magnets may, therefore, be retained on or within the rotor itself. It may be particularly advantageous for magnets to be retained within the rotor itself. Thus the magnets are protected from any corrosive effect of the driving fluid.

An advantage of mounting magnets on or within a radial flow rotor is that a rotor shaft on which the rotor is mounted does not have to transmit torque for rotating the magnets, and a turbine using the rotor may be manufactured more simply and with lighter weight as a result. As an example, if the rotor shaft is a rotating shaft located within a housing by contact bearings, the only torque that needs to be transmitted through the shaft is the little torque required to overcome the inertia of the bearings; the shaft may therefore be lightweight. The magnets are, in this situation, driven by a force directly transmitted from the circumference of the rotor through the rotor itself.

It is clear that the rotor should be able to rotate about an axis. Preferably the rotor is cylindrical or disk shaped.

In a second aspect the invention may provide a rotor for a radial-flow turbine comprising a fluid-flow channel defining a fluid-flow path, the channel having a radial inlet with an inlet direction of between 3 and 45 degrees to a tangent of the rotor and a radial outlet with an outlet direction of between 3 and 45 degrees to the tangent of the rotor. Preferably the inlet and outlet direction are both between 5 and 30 degrees to the tangent of the rotor.

Preferably, the rotor comprises a plurality of fluid-flow channels, each channel defining a discrete fluid-flow path. Preferably the rotor may have between 20 and 400 fluid-flow channels, particularly preferably between 40 and 360 fluid-flow channels. Each channel may define a discrete fluid flow path with a radial inlet and a radial outlet.

The, or each, fluid-flow path may enter the rotor in the inlet direction, be deflected within the fluid-flow channel from the inlet direction by between 90 and 140 degrees, preferably by between 120 and 135 degrees, then further deflected axially within the rotor and finally deflected radially to exit the rotor in the outlet direction.

Preferably the cross sectional area of the fluid-flow channel at the inlet is greater than the cross sectional area of fluid-flow channel at the outlet.

The fluid flow channel may be defined as having a height measured in the axial direction of the rotor. Preferably the height of the fluid flow channel at the inlet is greater than, and particularly preferably about three times greater than, the height of the fluid flow channel at the outlet.

In a third aspect the invention may provide a rotor for a radial flow turbine, the rotor comprising a plurality of plates or disks coupled together for rotation about a common axis. Advantageously, the rotor may comprise an impulse plate defining an impulse chamber having an inlet defined in a circumferential surface of the impulse plate, and a reaction plate defining a reaction chamber having an outlet defined in a circumferential surface of the reaction plate. The rotor may further comprise a partition plate to dispose between the impulse plate and the reaction plate.

The rotor may further comprise a location plate for locating a plurality of magnets. The magnets are preferably located around a radius of the magnet plate. The rotor may further comprise an end cap plate.

The impulse plate or the reaction plate may also serve as the or a location plate.

Preferably the impulse chamber of the rotor is disposed in fluid communication with the reaction chamber when the rotor is assembled.

Preferably the impulse plate is thicker than the reaction plate. Particularly preferably the impulse plate is about three times as thick as the reaction plate.

The impulse chamber and the reaction chamber may have heights substantially equal to the thickness of the impulse plate and reaction plate respectively.

Advantageously, the impulse plate and the reaction plate may be manufactured from an aluminium alloy.

A rotor according to any of the aspects defined above may be driven by a high velocity fluid, for example a compressed gas supply. Preferably, the rotor is driven by a phase-change fluid. Advantageously, the driving fluid used may be at a temperature below 80 degrees centigrade. This temperature is about the curie temperature of NdFeB magnets and, thus, use of a driving fluid at these temperatures negates the need for insulation for the magnets.

A rotor according to any of the aspects described above may be any functional diameter, preferably between 6" (15 cm) and 5' (152 cm) in diameter.

In a further aspect, the invention may provide a nozzle ring assembly for supplying driving fluid to a rotor of a radial flow turbine, the assembly comprising; a ring having an inner surface for encircling the rotor, a nozzle having an outlet defined in the inner surface of the ring, and a fluid inlet for supplying high pressure fluid to the nozzle. The purpose of the ring assembly is to provide the driving fluid to a radial flow turbine, the driving fluid being supplied, in use, radially towards a rotor disposed in the centre of the ring.

Preferably the nozzle ring assembly comprises a plurality of nozzles distributed around the ring, each having an outlet defined in the inner surface of the ring or directed towards the central portion of the ring. Multiple nozzles may improve the efficiency of a turbine utilizing the nozzle ring assembly. Nozzles have a number of functions that may include;

1, Provision of a non-leaking pressure channel to direct a driving fluid into a rotor at a predetermined angle intended to provide a high efficiency of energy transfer.

2, Provision of an appropriate geometric channel for the characteristics of the driving fluid. For example, if cold compressed air is used then a straight channel is preferred to a divergent channel in order to maintain the velocity of the gas at its highest, which in turn rotates the rotor at its greatest speed. In such a case a divergent channel would allow the compressed air driving fluid to slow down. However, if the driving fluid is a super heated vapour, such as produced under suitable conditions by a heated phase-change fluid, a divergent channel may accelerate the vapour to supersonic velocity. For any given system having a particular driving fluid at a given pressure, volume and flow-rate there is likely to be an optimum nozzle geometry that provides the best transfer of energy to the rotor.

For most applications the or each nozzle may have an opening width in the range from 0.25 mm to 10 mm. Preferably each nozzle opening has a width in the range 0.5 to 2.5 mm.

Advantageously, the nozzle ring assembly may further comprise a manifold distributed between the fluid inlet and the nozzle. The manifold may define a crescent shaped chamber allowing a single fluid inlet to supply a plurality of nozzles. For example, the crescent shaped chamber may encompass a plurality of nozzle inlets such that a pressurised fluid supplied through a fluid inlet would pressurise the crescent shaped chamber of the manifold and thereby supply fluid through the plurality of nozzles.

A manifold, or manifold assembly, may comprise a plurality of chambers, each chamber allowing a single fluid inlet to supply a plurality of nozzles with fluid. For example, the manifold may comprise three or four or five chambers and each of these chambers may be supplied by a separate fluid inlet.

An advantage of using a manifold having a plurality of chambers, each chamber supplying a plurality of nozzles, is that the number of nozzles supplying driving fluid to a rotor through the nozzle ring assembly may be easily controlled by means of a valve attached to a fluid inlet to each chamber. For example, in a nozzle ring assembly having a manifold with four chambers, each chamber supplied by a respective fluid inlet, valves may control the nozzle ring assembly to allow fluid to pass through only one manifold chamber or two manifold chambers or all of the manifold chambers.

Advantageously, the, or each, nozzle may be defined in a removable insert. Such a removable insert may be locatable or seatable in the ring such that the nozzle outlet opens through the inner surface of the ring. Location of a nozzle insert may be achieved by using a screw. The use of nozzle ring inserts allows the profile of the nozzle to be swiftly altered thereby allowing the nozzle characteristics to be tailored for a particular driving fluid or driving fluid pressure. Thus, the use of inserts may allow a turbine incorporating a nozzle ring assembly as described here to be optimised for a particular purpose. For example, tailoring the nozzle geometry, the drive-fluid and the drive-fluid pressure may allow a turbine generator incorporating the nozzle ring assembly to vary its power output. The same generator may therefore be able to be tuned to operate at, for example, 10 kW or 15 kW or 20 kW.

The use of removable inserts may be particularly advantageous when a turbine generator is being tuned for a particular application, i.e. to operate at a particular performance level. It may be possible for the nozzles to be exchanged to iteratively determine an optimum nozzle dimension to provide a desired fluid velocity or fluid flow-rate. Once an optimum dimension has been determined then generators for the same application could be produced with nozzle ring assemblies having fixed nozzles of the optimum size.

Removable inserts may also allow for the replacement of nozzles damaged, for example by nozzle erosion.

Preferably the nozzle ring assembly is in the form of a ring having a substantially circular inner surface for encircling a substantially circular rotor. Preferably a driving fluid is supplied to the nozzle ring assembly in an axial direction, i.e. a direction perpendicular to a radius of the ring, and the nozzle ring assembly re-directs the fluid radially through the inner surface of the ring.

The fluid inlet of the nozzle ring assembly may comprise an expansion nozzle. Such an expansion nozzle may be an incoming pipe that increases in diameter, for example from a ¼ inch (0.64 cm) to a ½ inch (1.27 cm) diameter. The use of an expansion nozzle may have benefit when the driving fluid is a phase change fluid. In this situation the fluid may be pressurised and heated within a fluid supply system in the liquid state but on reaching an expansion nozzle the phase change fluid may change state to being a gas. The change in state of a phase change fluid from a pressurised liquid to a gas may increase the velocity of the fluid available for driving a rotor of a turbine.

In a further aspect the invention may provide a method of driving a rotor for a radial flow turbine, the rotor defining an internal fluid-flow channel, the method comprising the steps of; directing a fluid into an inlet of the fluid-flow channel in an inlet direction, deflecting the fluid within the channel such that a first force acts to turn the rotor, deflecting the fluid axially within the rotor, and deflecting the fluid in the fluid-flow channel to pass out of an outlet in an outlet direction such that a second force acts to turn the rotor. The method may comprise steps of slowing the incoming fluid and compressing the incoming fluid as it is deflected radially and axially on entering the fluid-flow channel. The method may also comprise a step of accelerating the fluid as it is deflected towards the outlet.

Thus, fluid directed into the fluid-flow channel may interact with the rotor to provide an impulse force that acts to turn the rotor. Likewise, the fluid exiting the fluid-flow channel may be accelerated and directed such that it provides a reaction force to the rotor acting to turn the rotor in the same direction that the impulse force acted.

In a further aspect the invention may provide a disk for a turbine generator rotatable about its centre and within which a location opening is defined for locating an object, the location opening being spaced from the centre of the disk and in which a first portion of a perimeter of the opening is defined by a first surface having a first radius, a second portion of the perimeter of the opening faces the first portion of the perimeter of the opening and is defined by a second surface having a second radius that is greater than the first radius, the second surface facing the centre of the disk, and a third surface defines a notch in the first surface. Such a disk may advantageously be used for locating an object, particularly a cylindrical object such as a magnet, within a turbine generator. Preferably, the first surface is of substantially the same radius as an outer surface of the object. The object should, preferably, snugly engage with the first surface.

Preferably, the second surface, being of greater radius than the first surface, defines an offset for locating a cushioning means between the second surface and the located object. Such a cushioning means may be a strip of polymer, for instance a high temperature polymer. A preferred cushioning means is a strip of Teflon.

Preferably the third surface defines a notch for receiving a dowel. Thus, the assembled disk may comprise a cylindrical object such as a magnet located such that its circumference mates with the first surface, the cushioning means located between the second surface and the circumference of the object, and a dowel located by the third surface and a point on the circumference of the object.

The disk may comprise a plurality of location openings for locating a plurality of objects, and each such opening is preferably located at a similar radius from the centre of the disk.

The location openings may be an opening or openings through a disk or they may be blind openings, i.e. openings that do not pass all the way through the disk.

The invention may also provide a radial flow turbine comprising a rotor according to any aspect described above, a nozzle ring assembly according to any aspect as described above, a location disk as described above or any combination of these aspects. Such a turbine or turbine generator generates electricity by moving magnets relative to coils of wire and may be rated to develop a low power output for domestic use, for example 1 or 2 kW or 5 kW. Turbine generators can be produced with more power output, for example 10 or 15 or 20 kW. Large office blocks, or shops, may demand higher output, for example a generator between 20 and 100 kW. Light industry may use a turbine generator with a power output of the order of 250 kW.

The invention may further define a system for generating electricity from waste heat comprising a heat exchanger containing a fluid for extracting waste heat and a turbine as described herein. The system may further comprise a condenser and a pump. Preferably the system is drivable by a phase change fluid. Other components of a system may include: a storage reservoir for the fluid; a liquid boost pump; plumbing; and an electric control package.

A turbine generator according to an aspect of the present invention can be driven by a high-pressure fluid that can be heated by any persistent heat source. The fluid may be caused to flow through a rotor of the generator, causing an impulse and reaction drive to the rotor.

Advantageously, where the driving fluid is a low-temperature phase-change fluid, such a turbine generator may be manufactured at a much reduced cost per kilowatt hour (KWh) of generating capacity as compared to current systems. Traditional turbines use a high temperature fluid to provide a driving force, for example an exhaust gas stream drives a turbine in a vehicle engine. The use of high temperatures means that the turbine components must be made from high temperature resistant materials, for example nickel alloys or ceramics. Low temperature phase change fluids (such as Honeywell R-245fa (1,1,1,3,3-Pentafluoropropane) which has a boiling point of 59.5 degrees F. (15.3 degrees centigrade)) allow the turbine components to be manufactured from standard materials such as aluminium.

In a preferred embodiment there may be incorporated into the rotor a set of Nd—Fe—B super magnets. These magnets may arranged to move past a set of generator induction coils that are located on each side of the turbine rotor within the turbine casing. The turbine rotor and the generator induction coils are all part of a single power unit.

Advantageously, the coils may be constructed from copper wire wound onto a non-magnetic core and preferably a non-metallic core. Thus the coils should not latch onto the magnets held by the rotor (which could occur, for example, if there were an equal number of coils and magnets and the coils were wound onto a magnetic core or an attractive metallic core), thereby reducing the initial forces that need to be overcome to turn the rotor.

DETAILED DESCRIPTION OF SPECIFIC EMBODIMENTS AND BEST MODE

Figure 2:
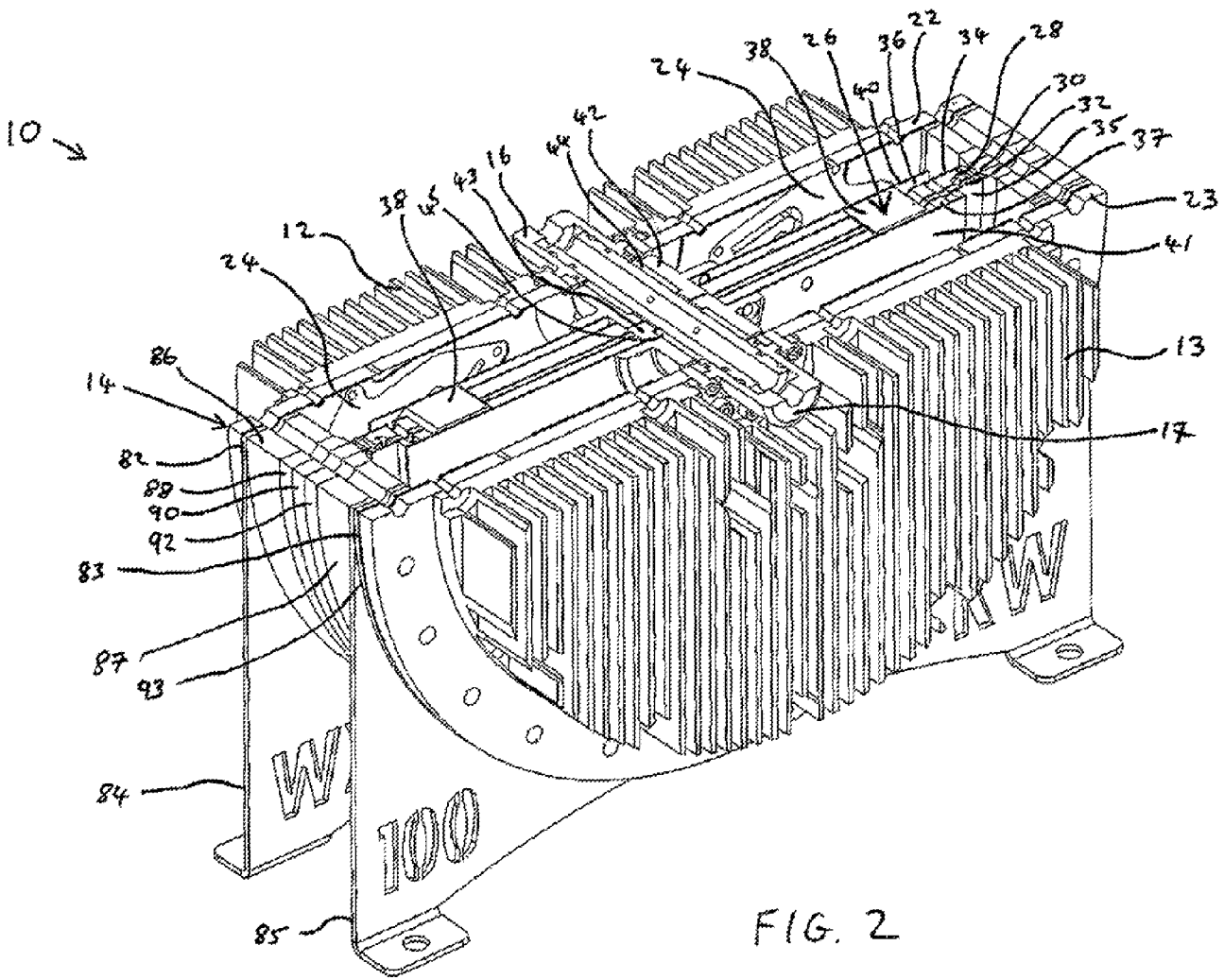
Figure 3:
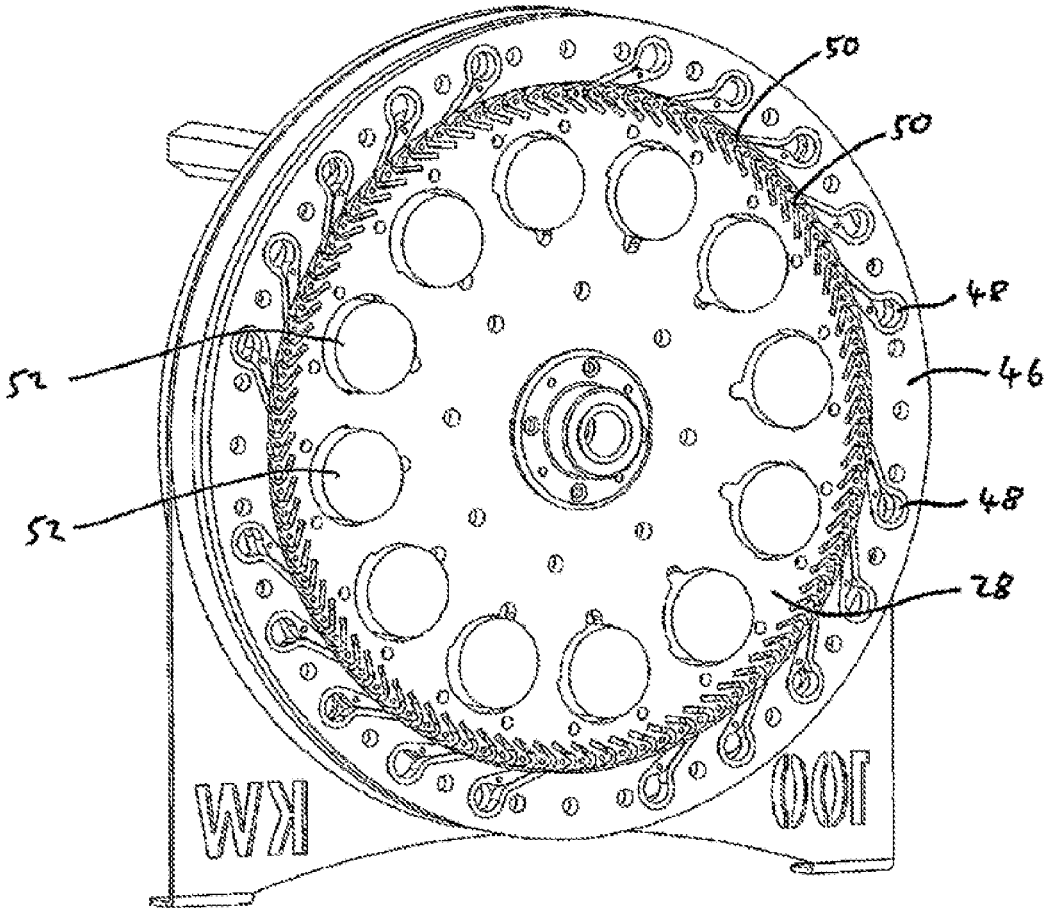
Figure 4:
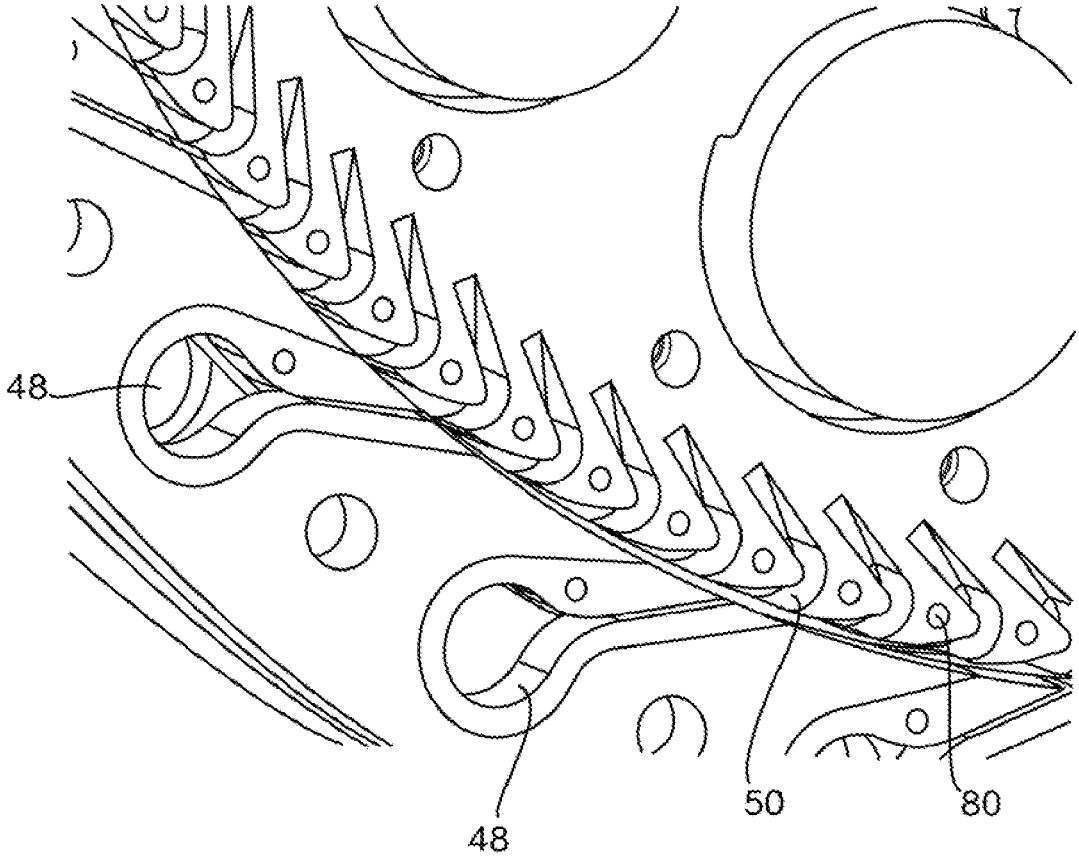
Figure 5A:
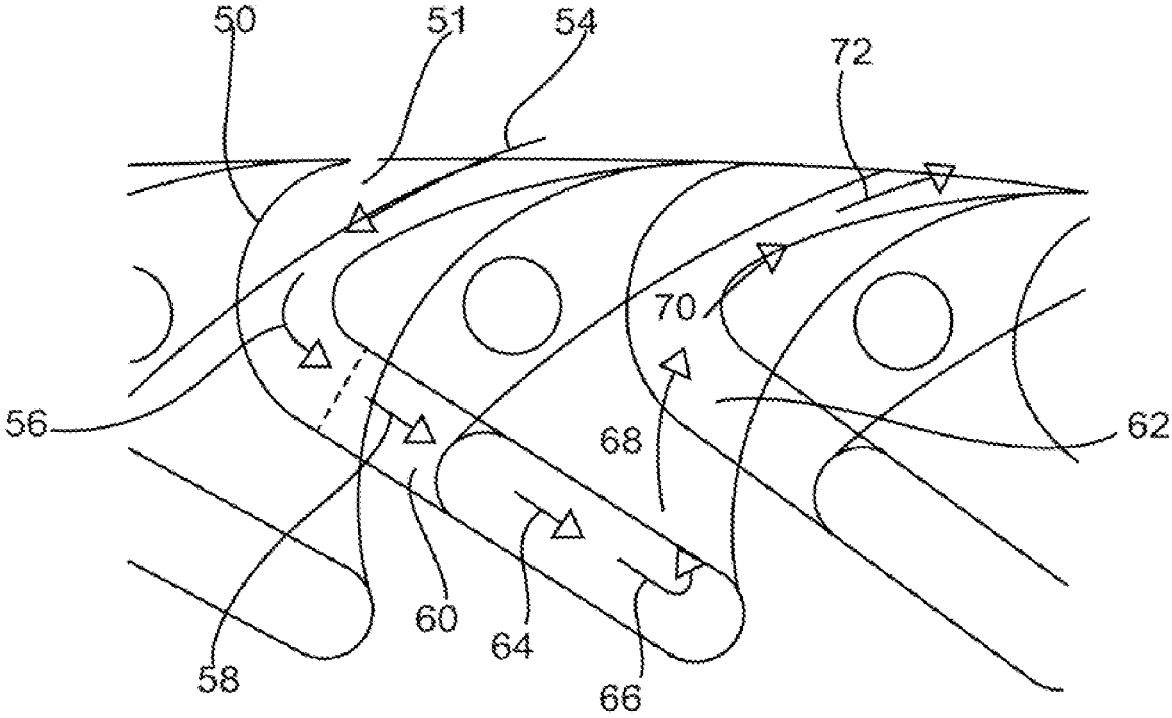
Figure 5B:
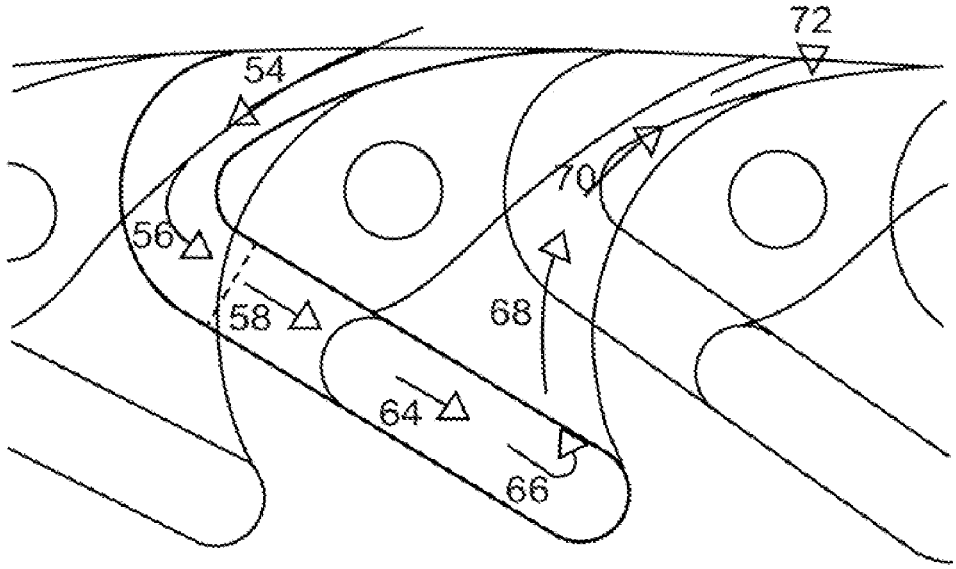

A detailed description now follows of an embodiment of a device according to various aspects of the invention making reference to figures, in which;

FIG. 1 is a perspective view of the exterior of a turbine generator according to an aspect of the invention, FIG. 2 is a perspective sectional view of the turbine generator of FIG. 1, FIG. 3 is a cut away view of the turbine generator of FIG. 1 illustrating a nozzle ring and a rotor according to aspects of the invention, FIG. 4 is a view showing a nozzle ring and a rotor array within the turbine generator of FIG. 1, FIG. 5*a* is a schematic diagram illustrating a fluid flow path through a rotor according to an aspect of the invention, FIG. 5*b* is a schematic diagram illustrating a fluid flow path through a rotor according to an aspect of the invention.

Figure 6:
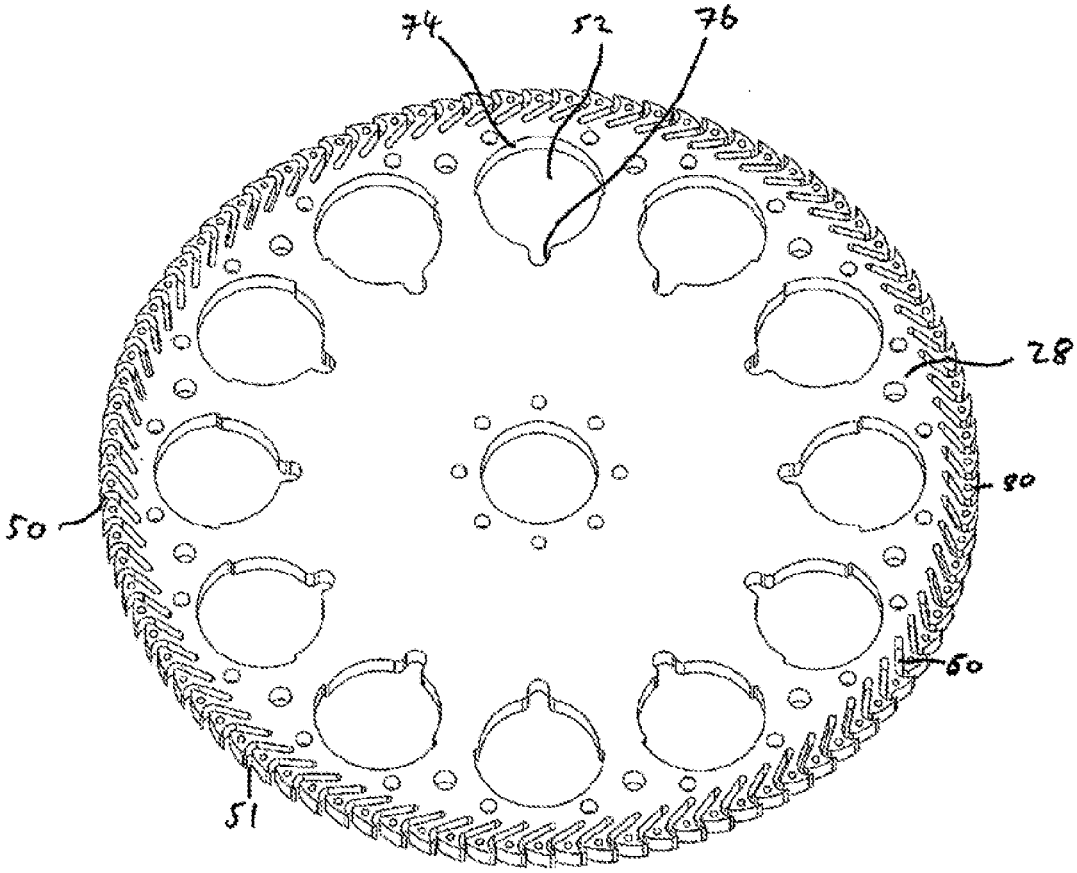
Figure 7:
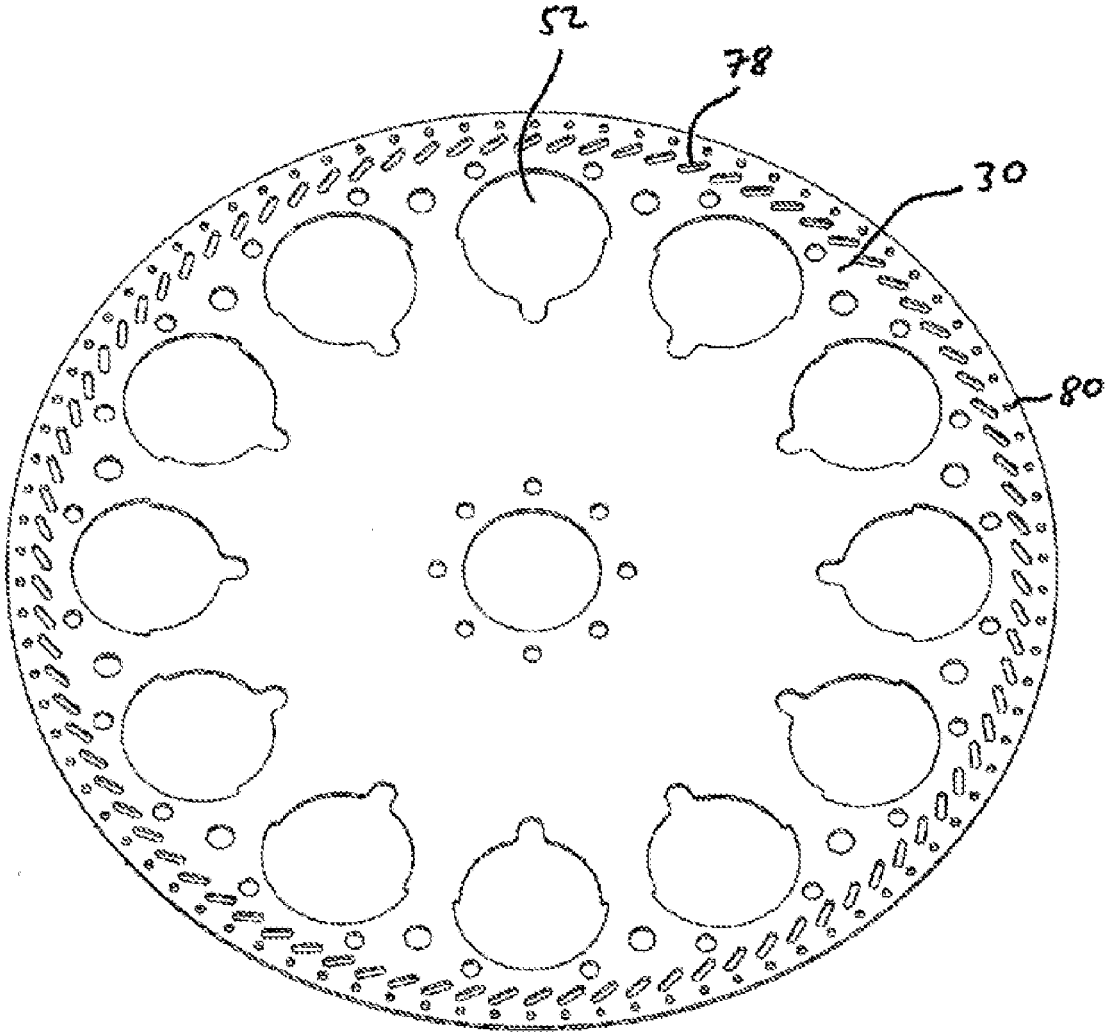
Figure 8:
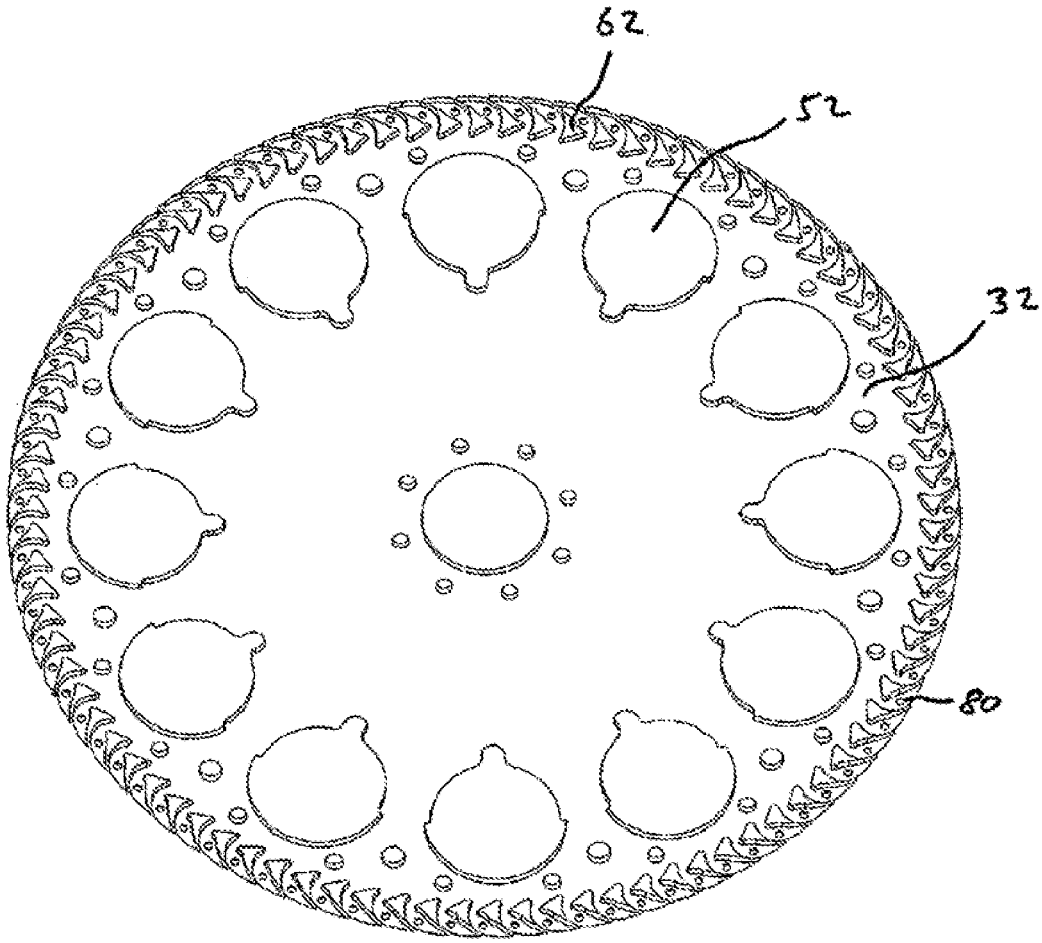
Figure 9:
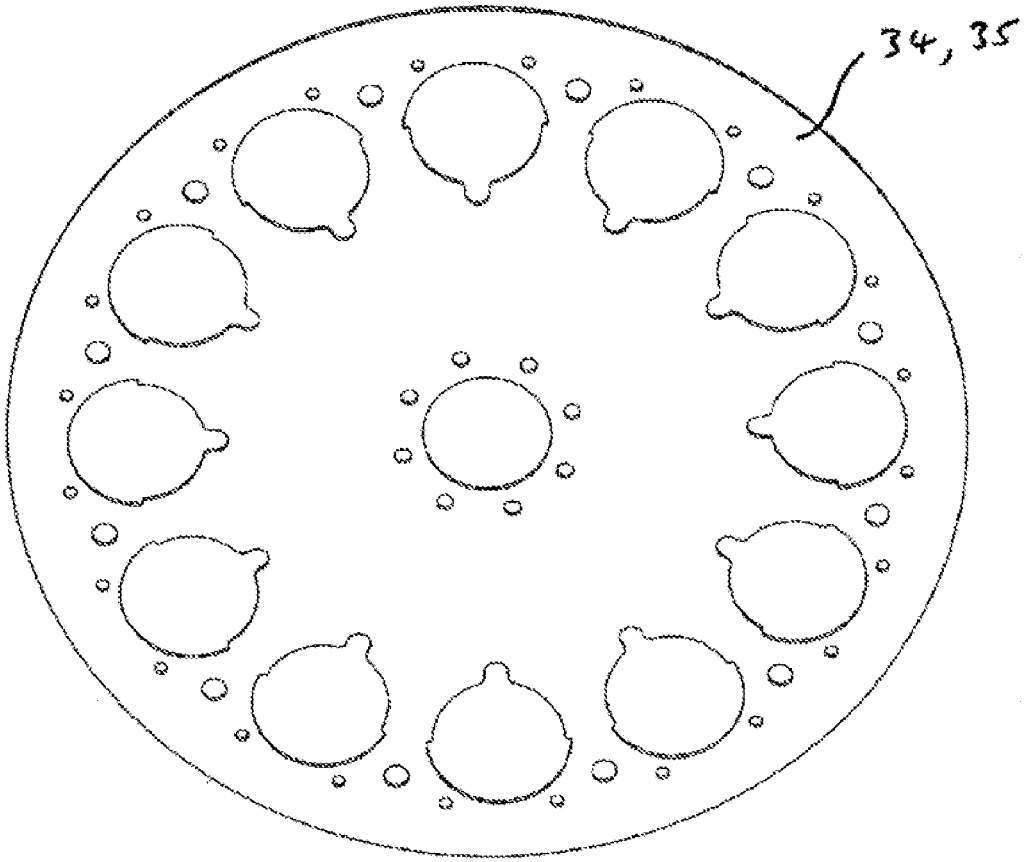
Figure 10:
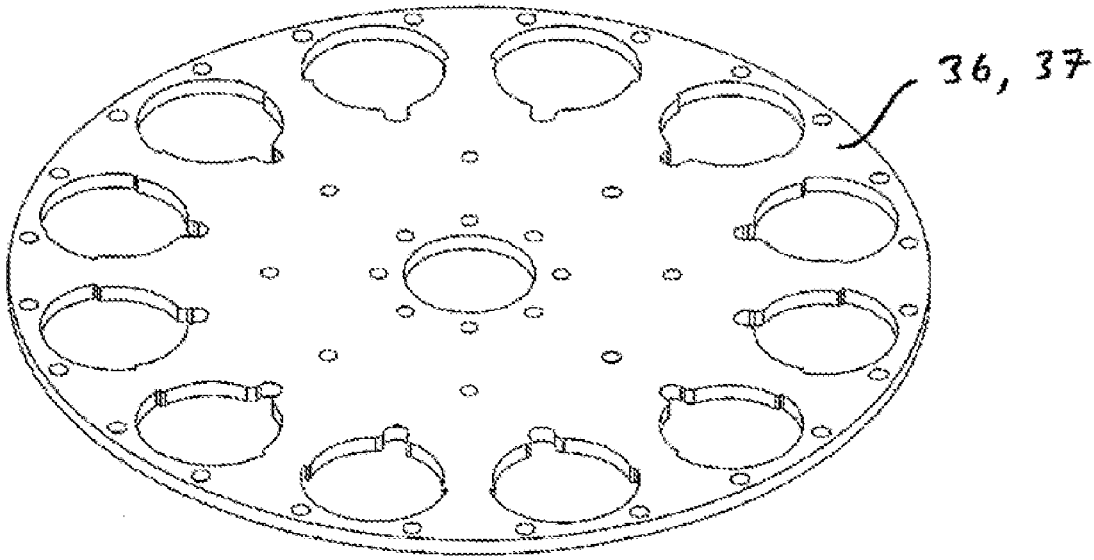
Figure 11:
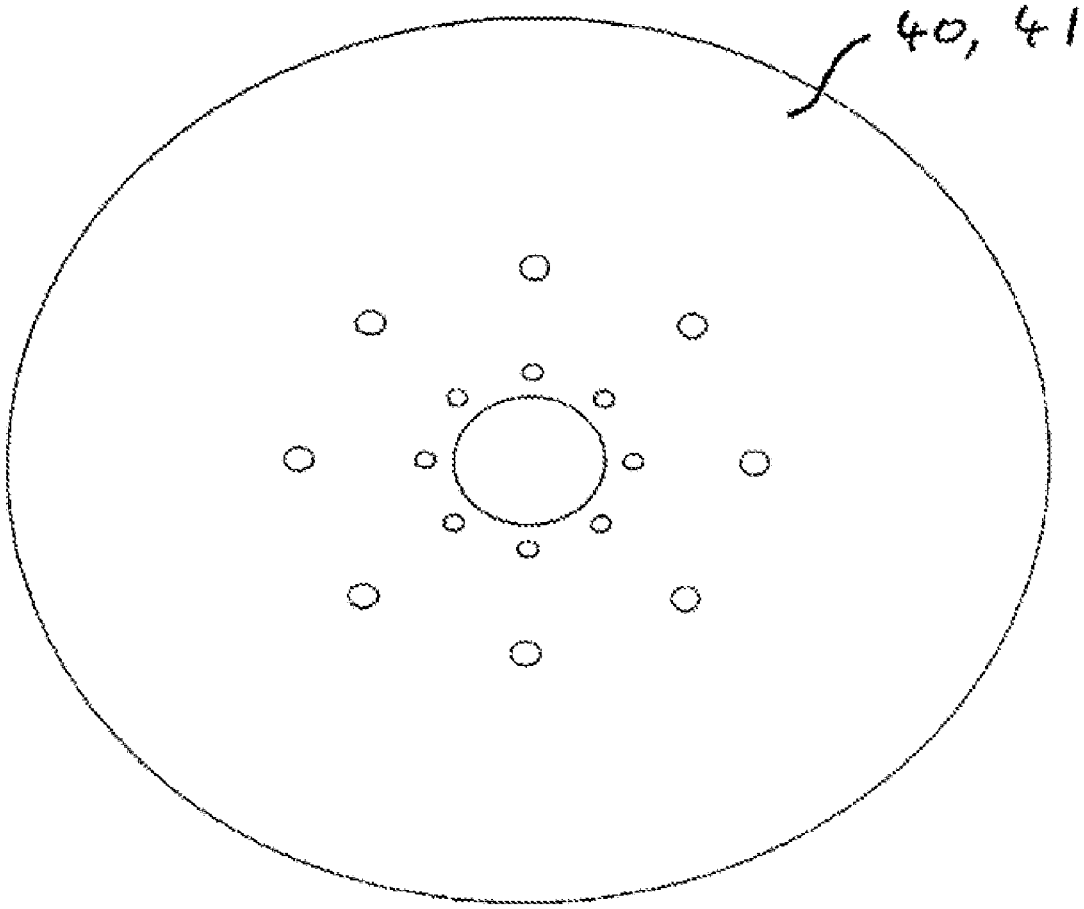
Figure 12:
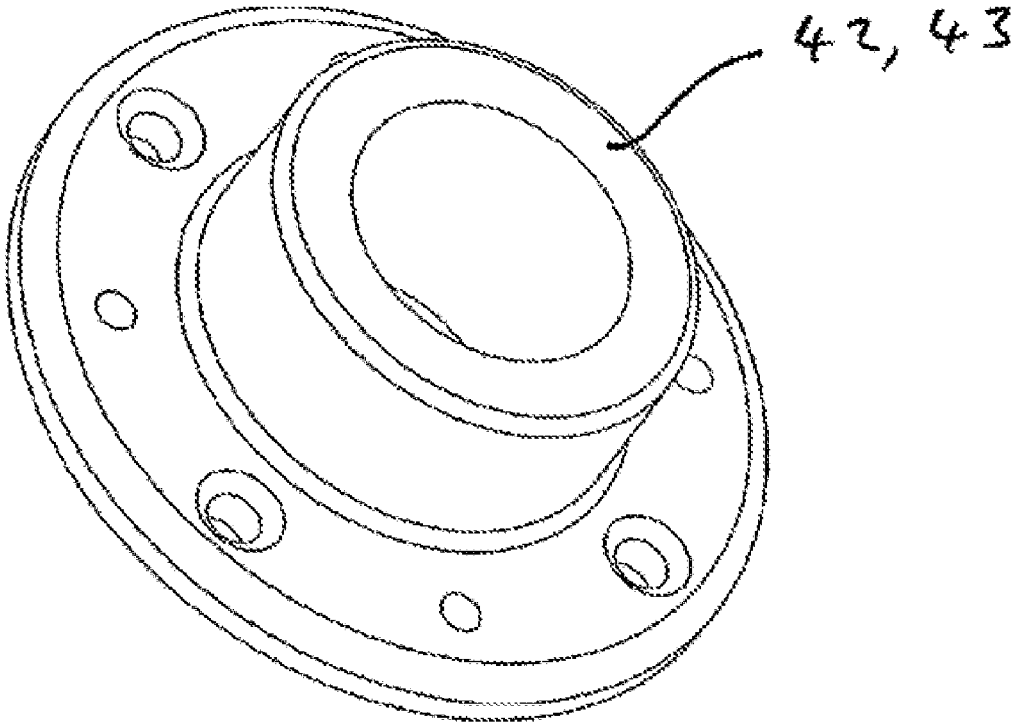
Figure 13:
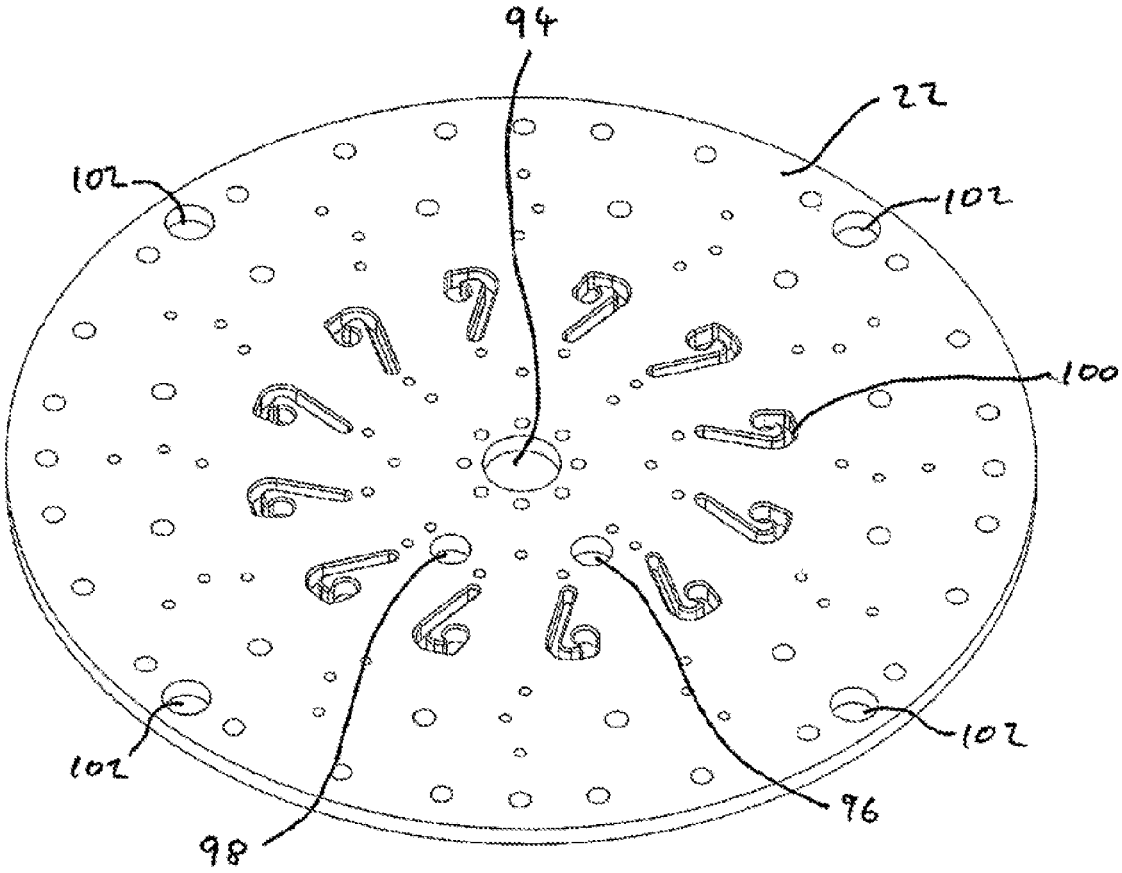
Figure 14:
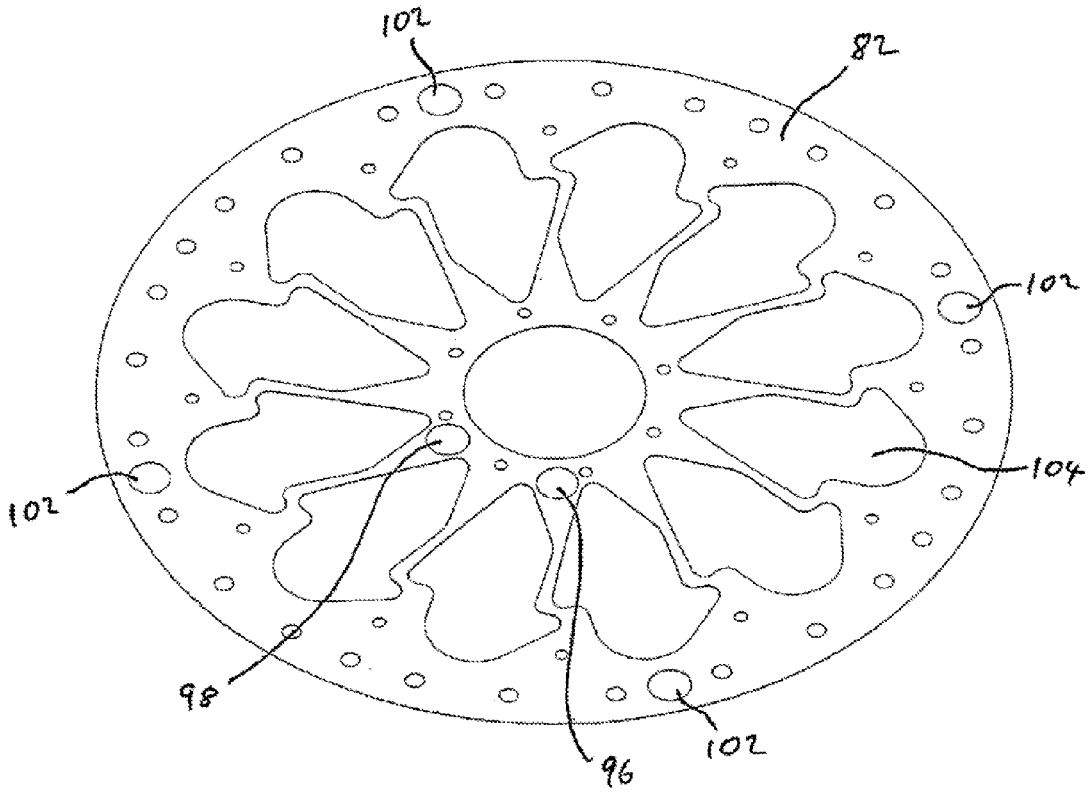
Figure 15:
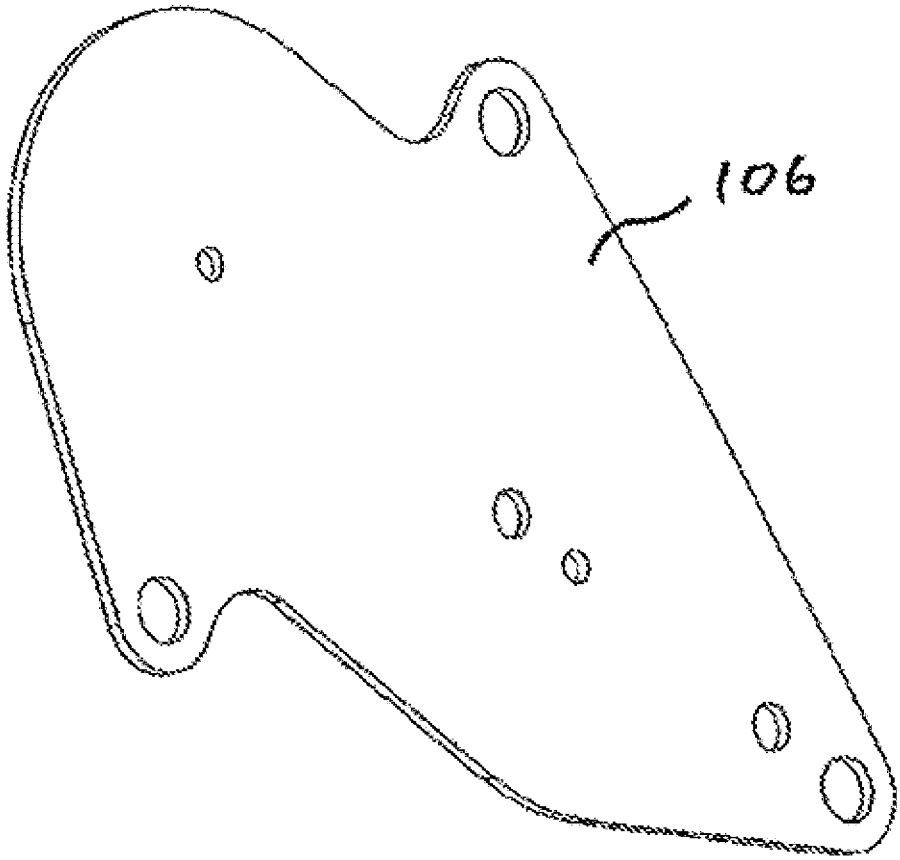
Figure 16:
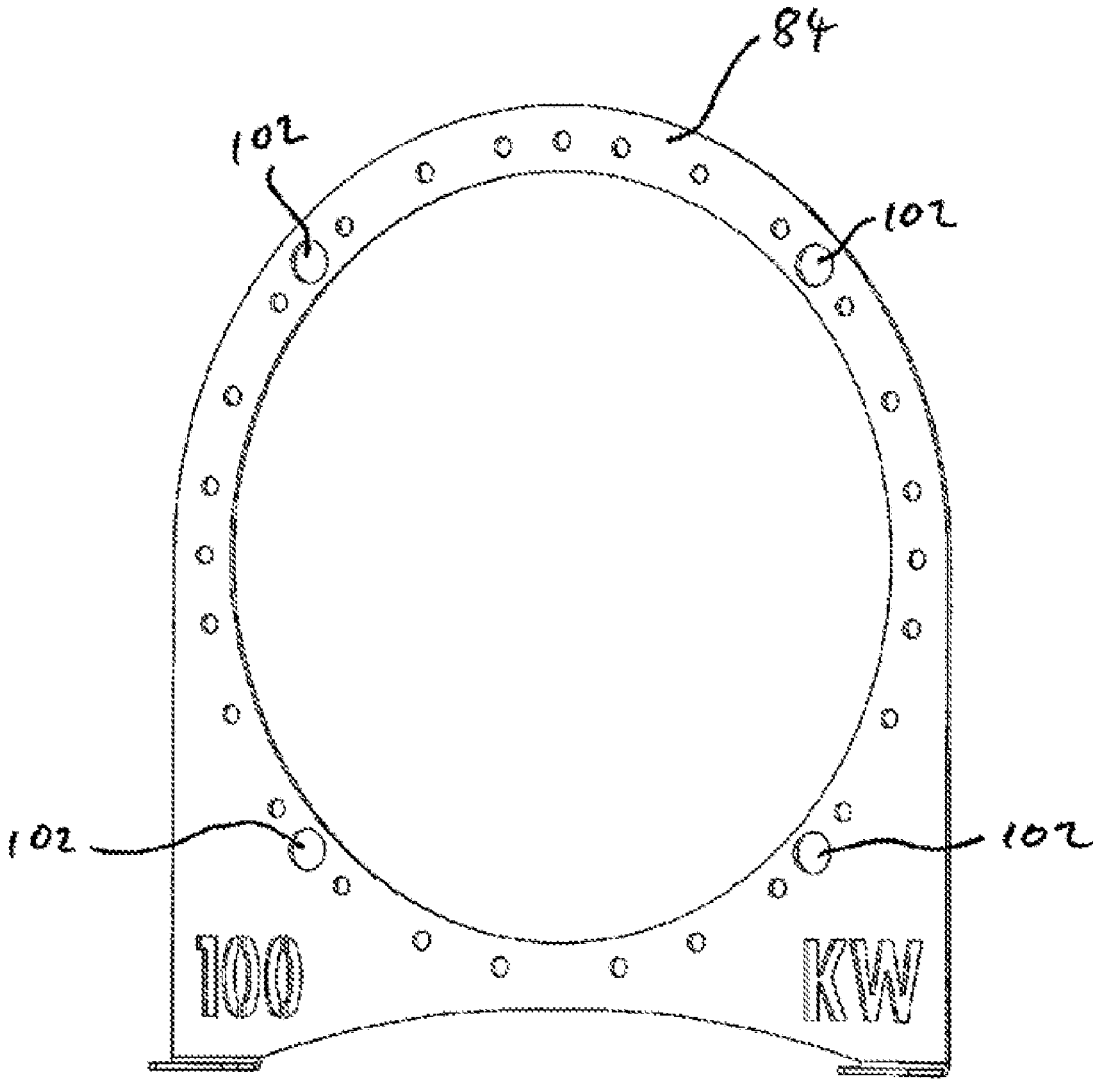
Figure 17:
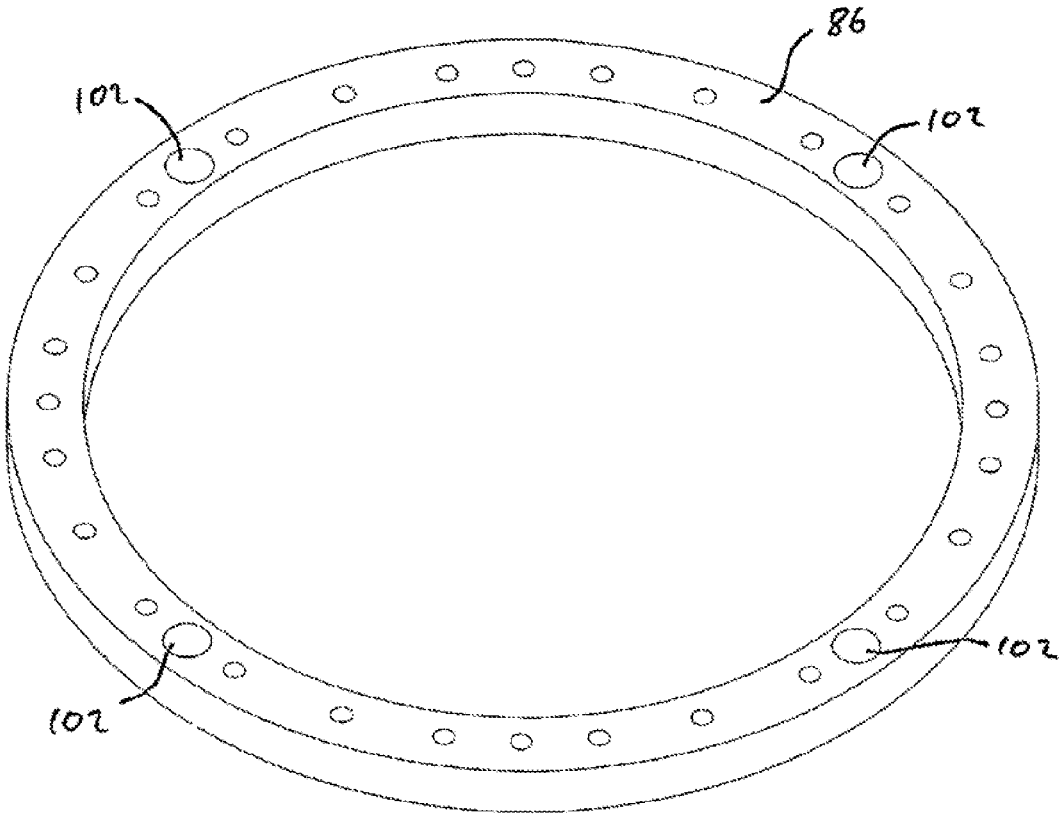
Figure 18:
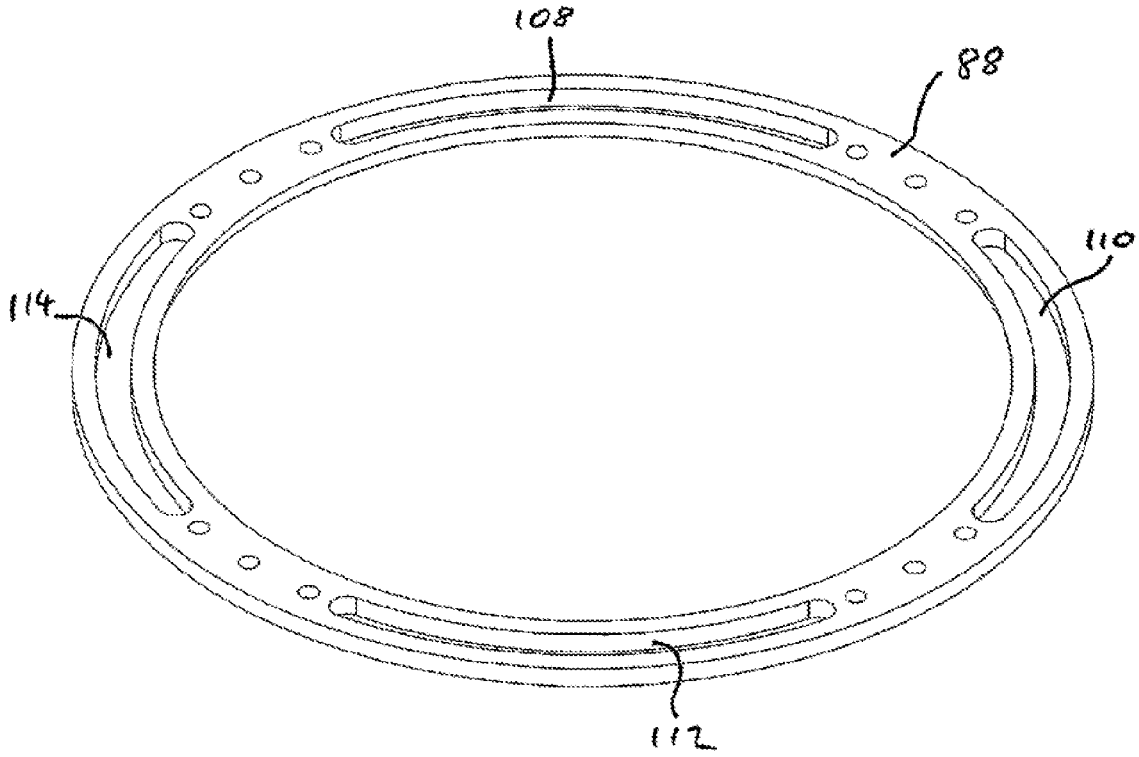
Figure 19:
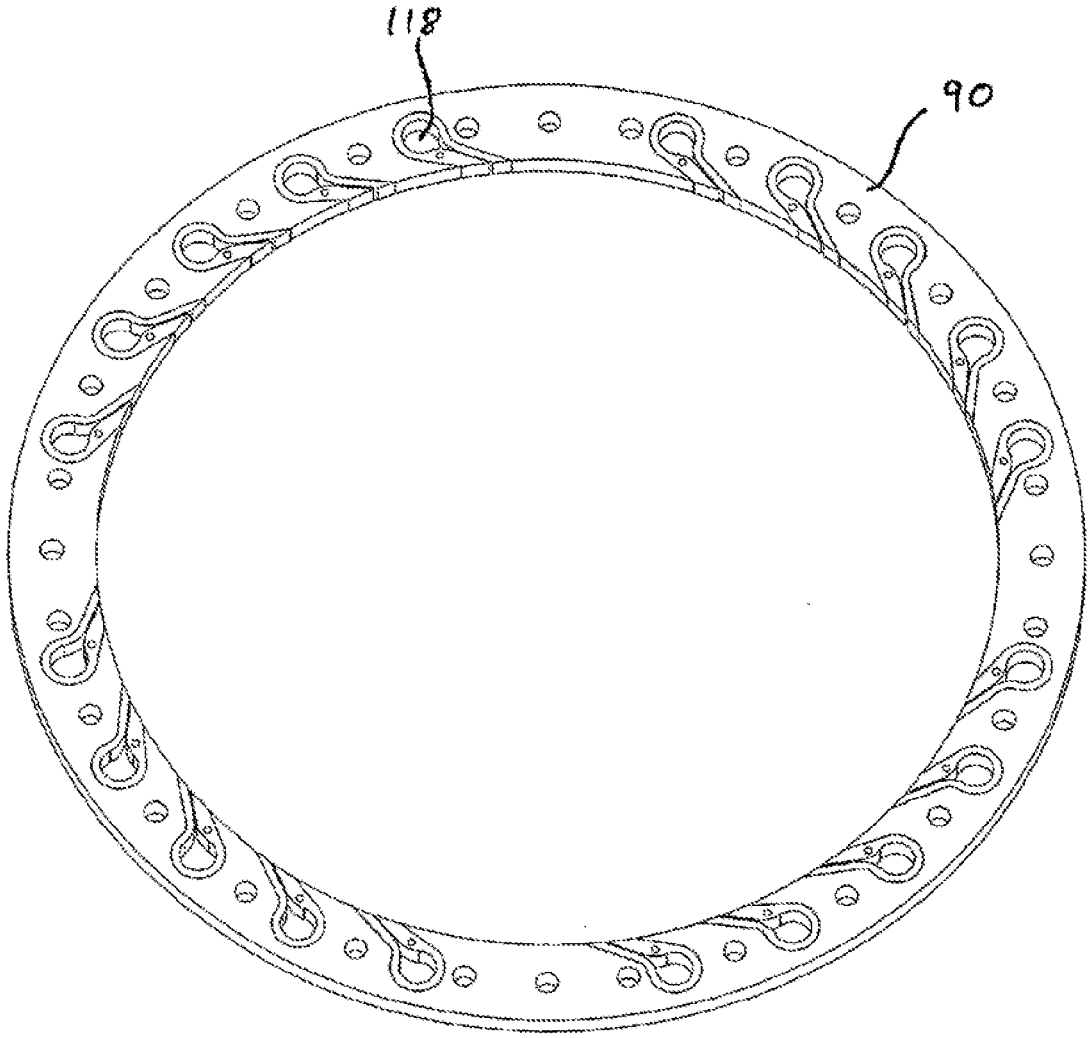
Figure 20:
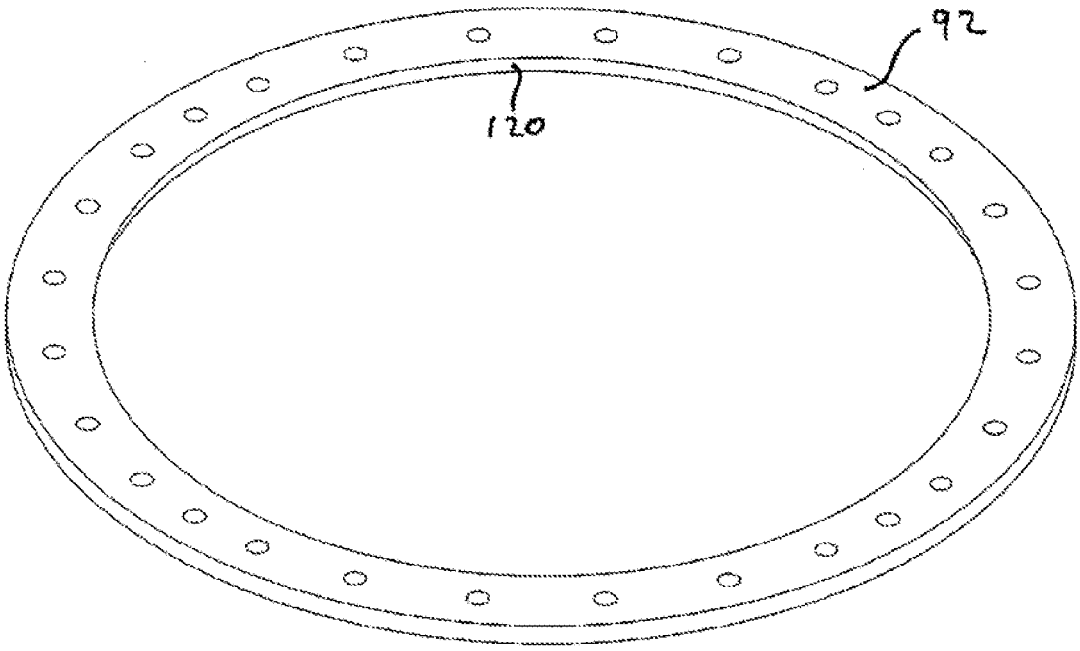
Figure 21:
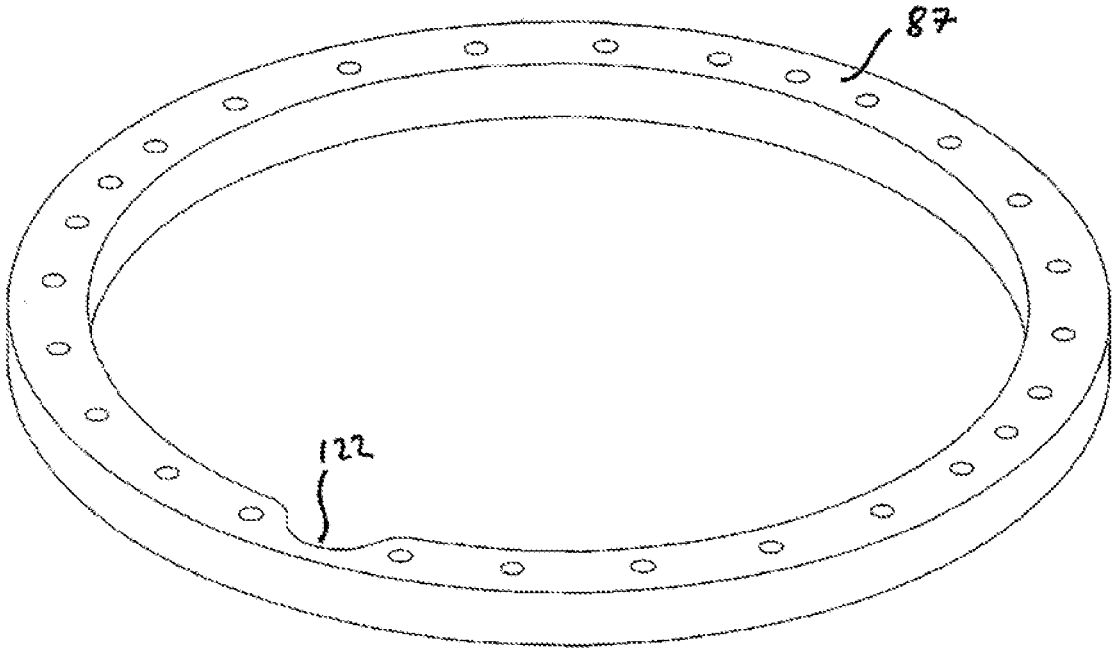
Figure 22:
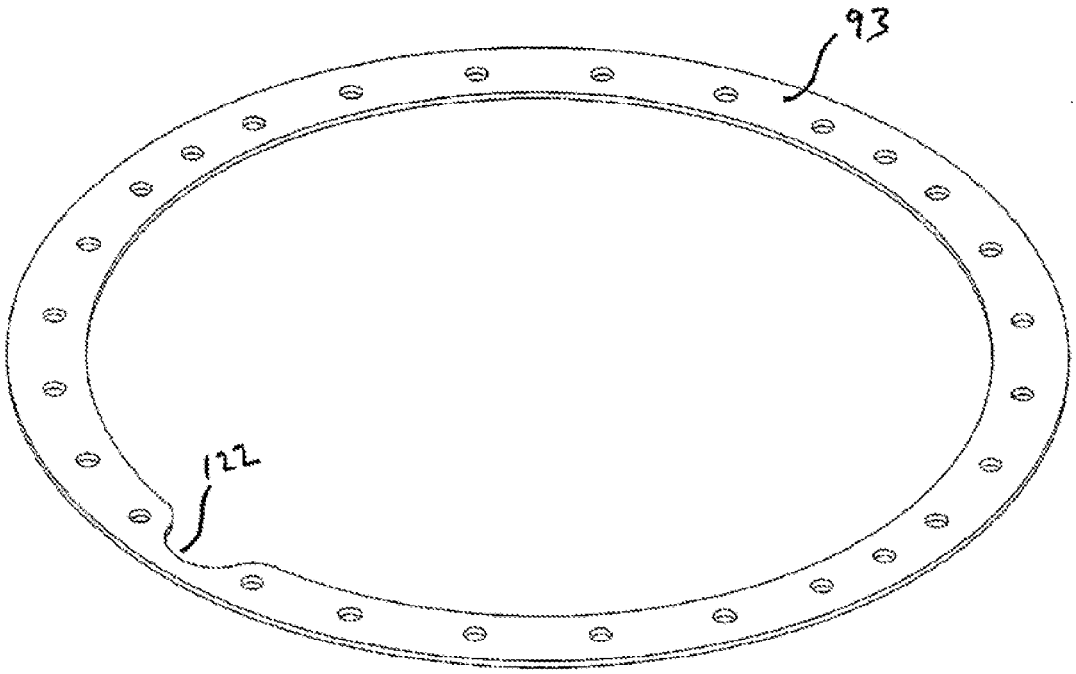
Figure 23:
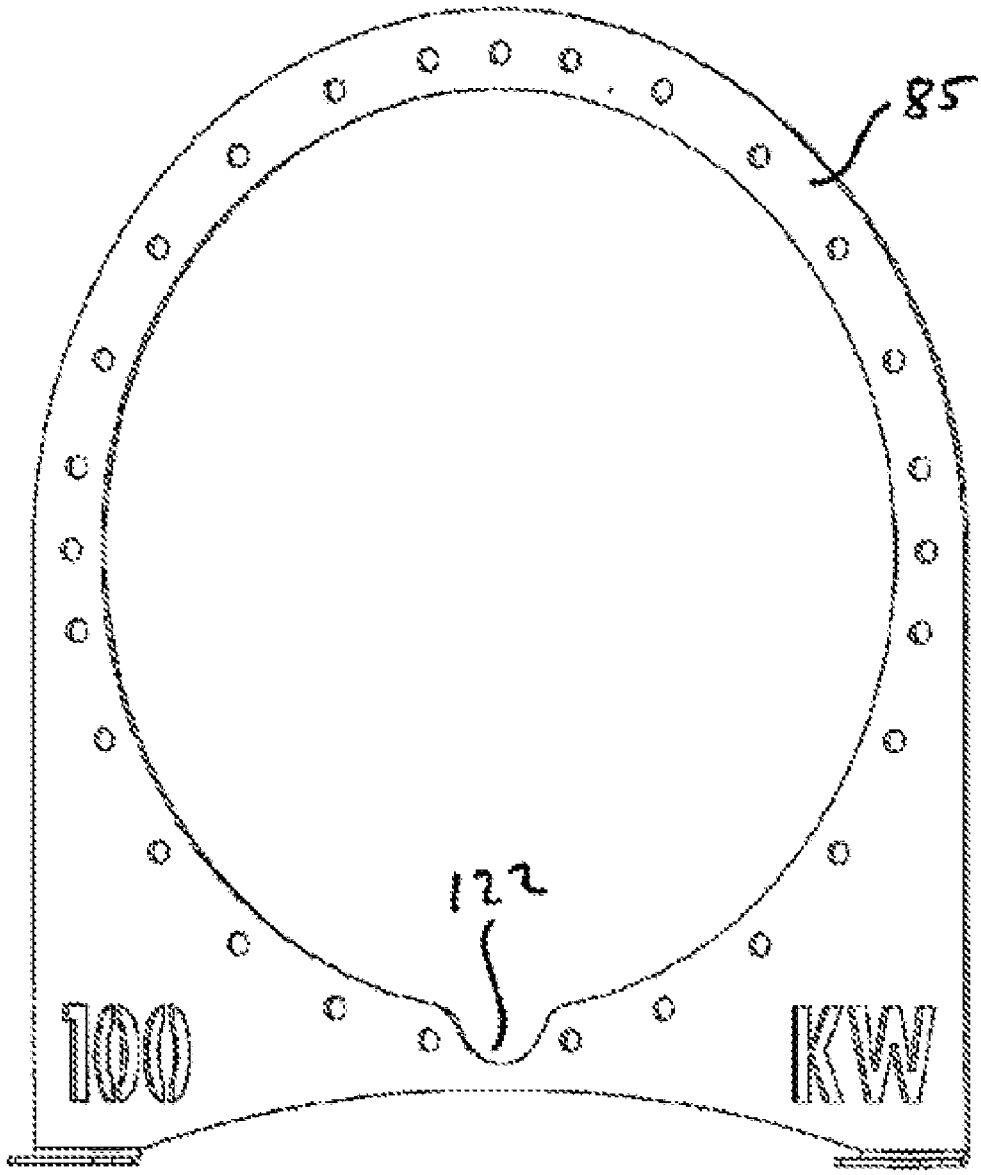
Figure 24:
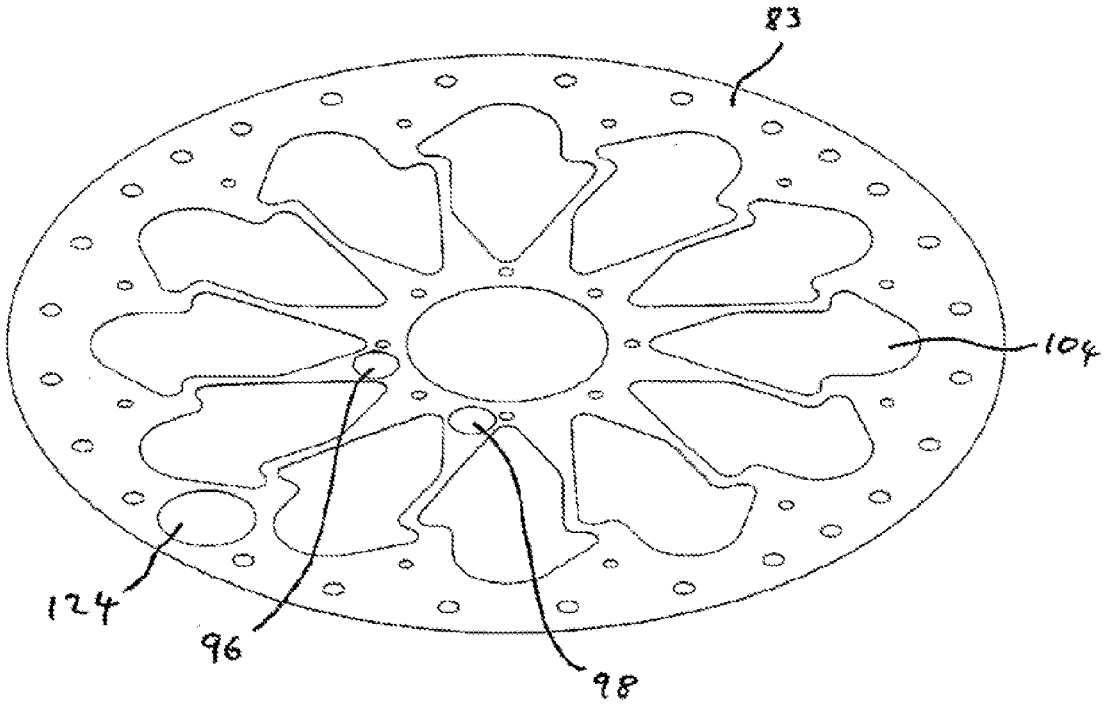
Figure 25:
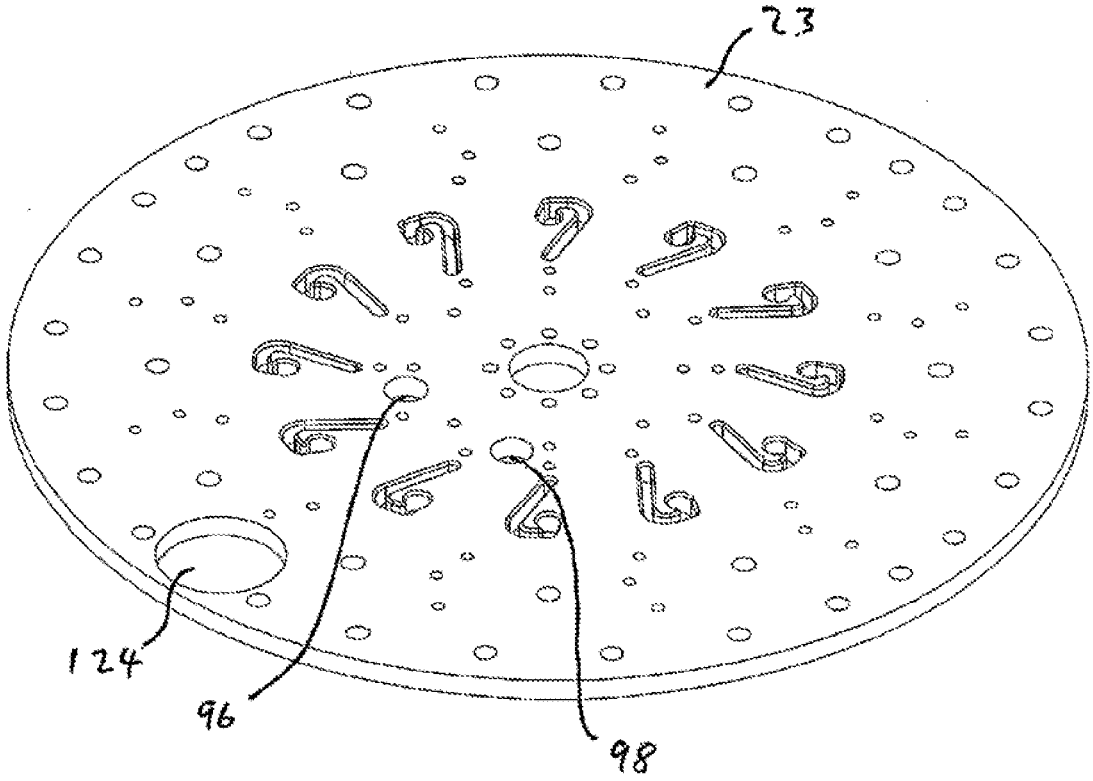
Figure 26:
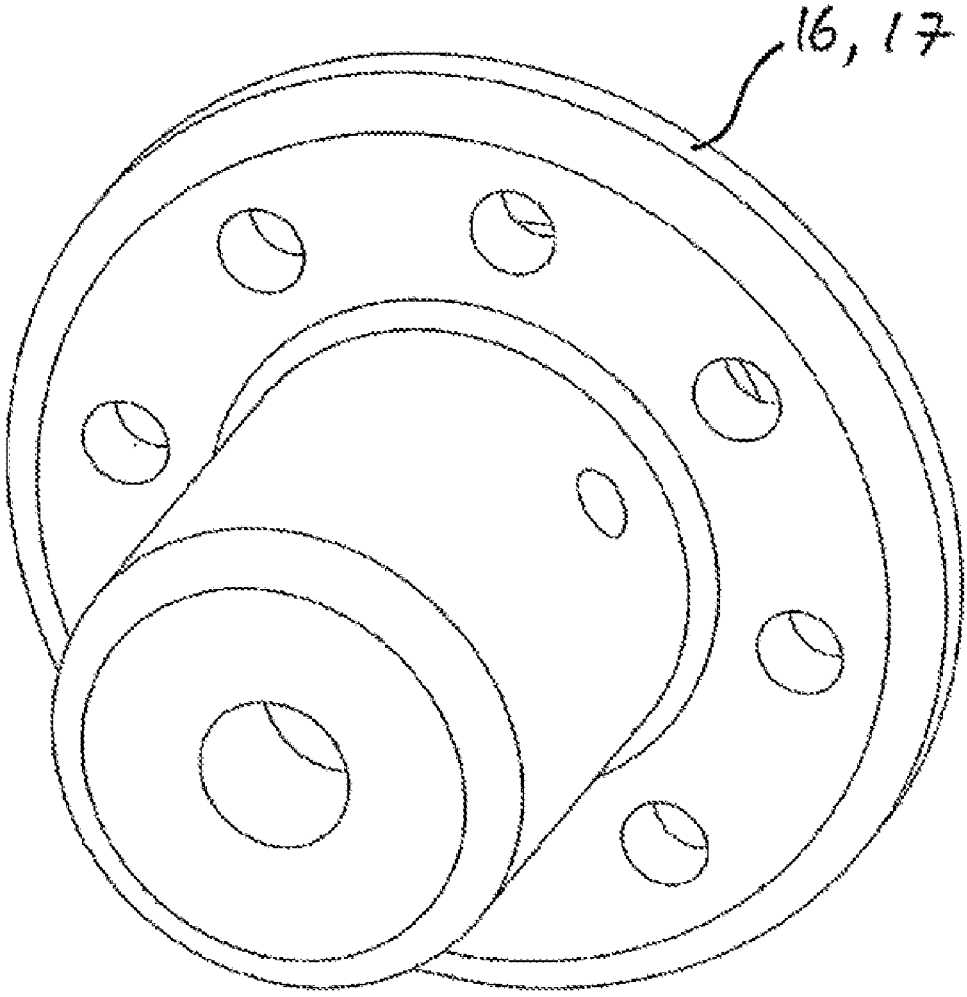
Figure 27:
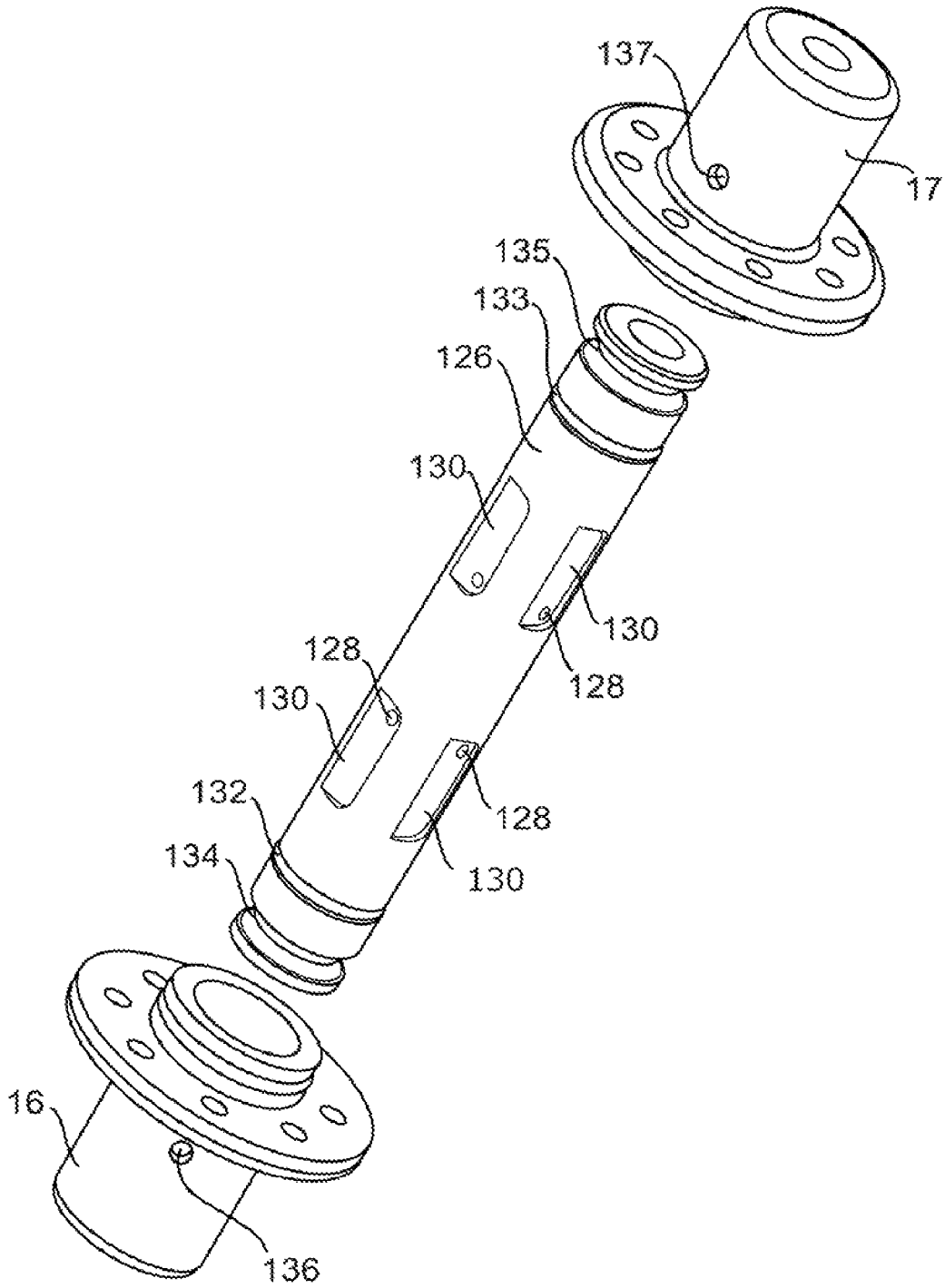
Figure 28:
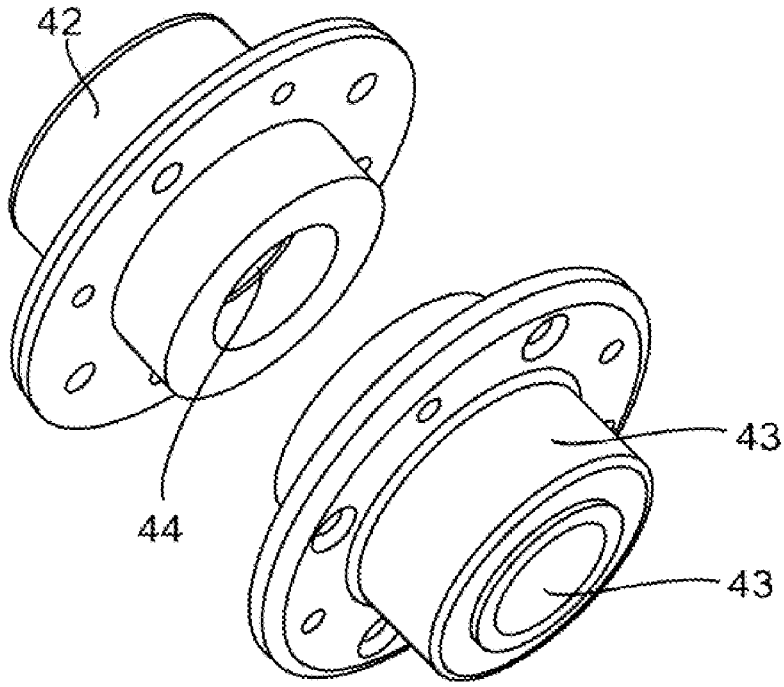
Figure 29:
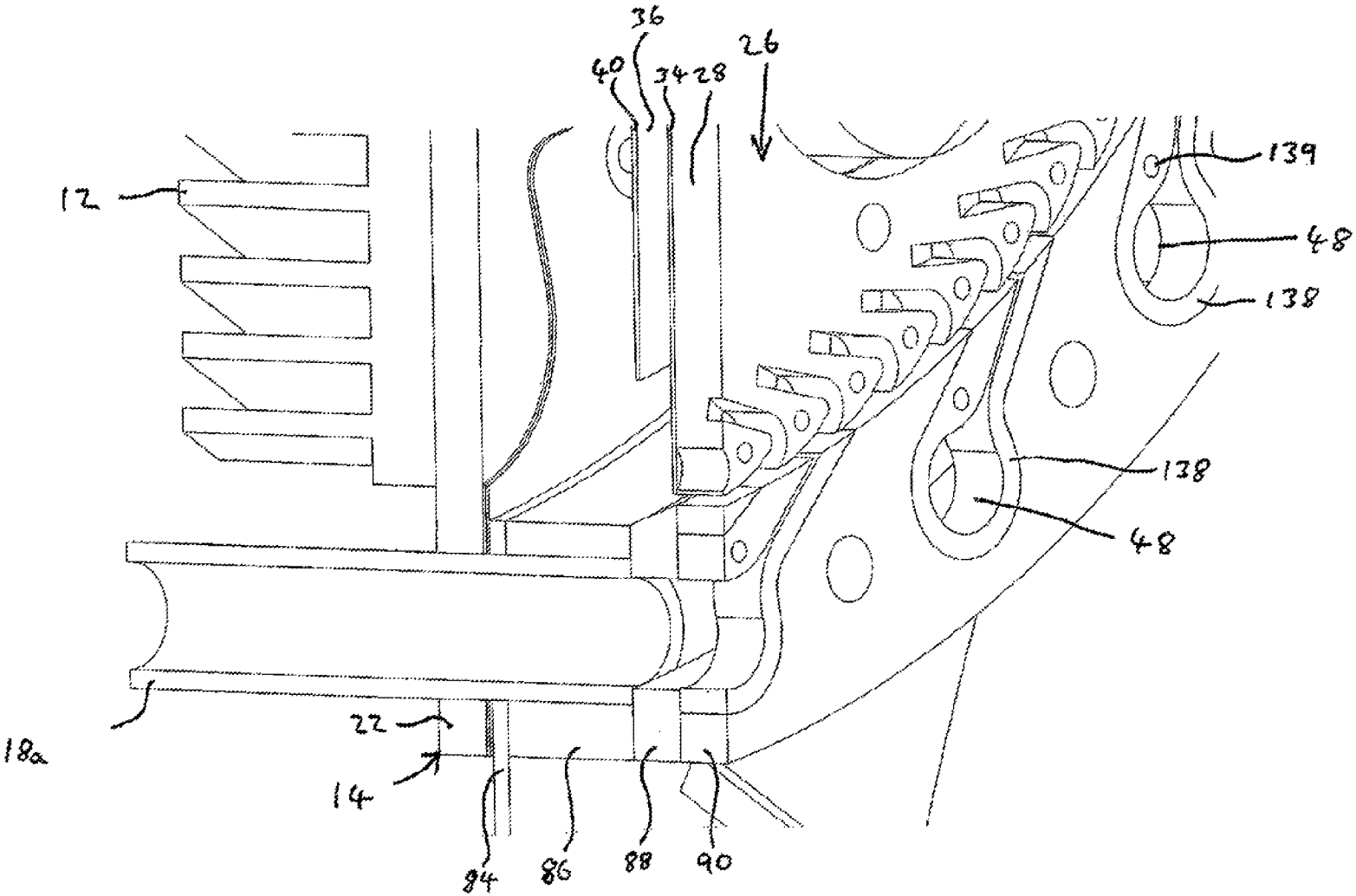
Figure 30:
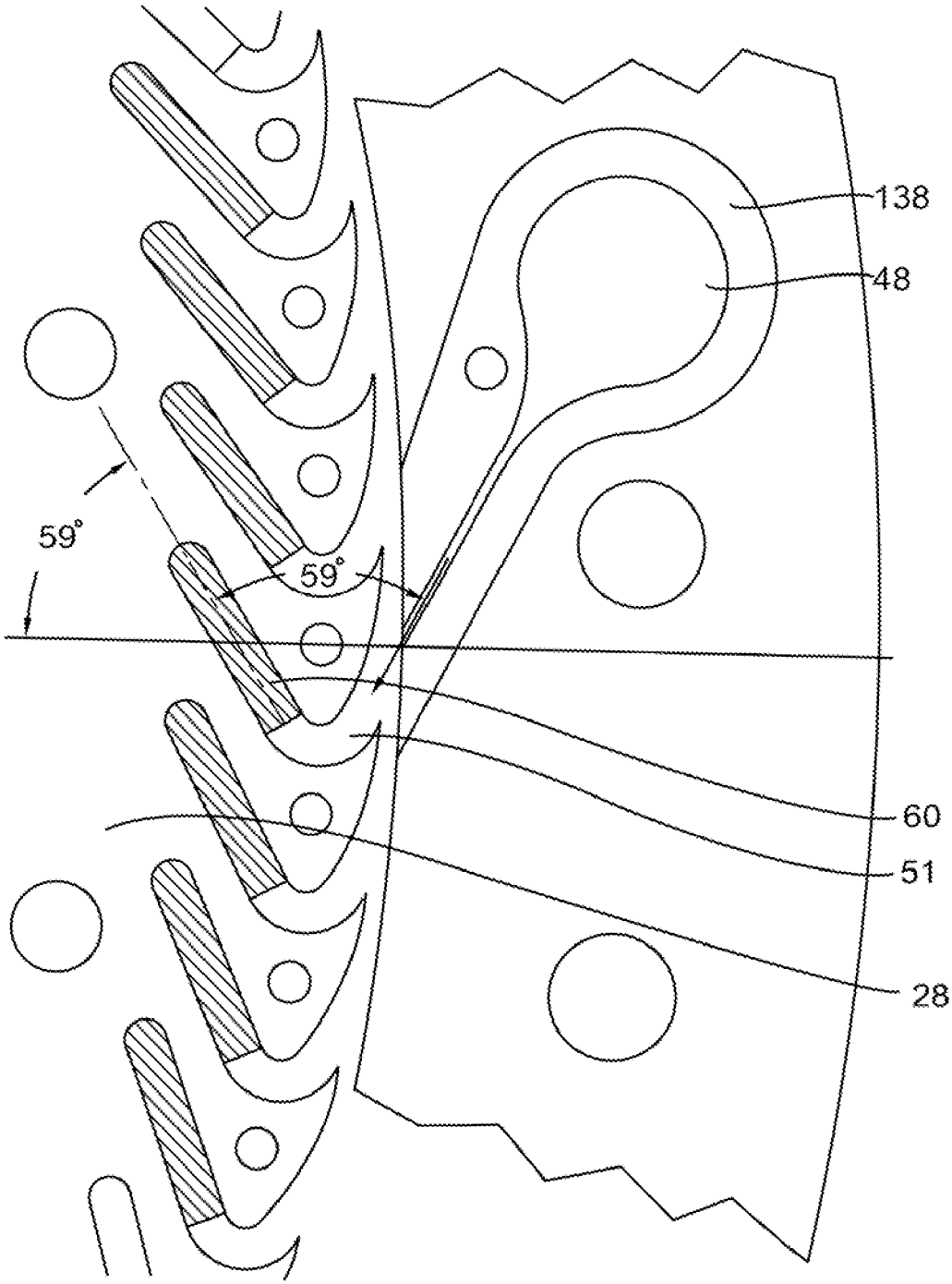
Figure 31:
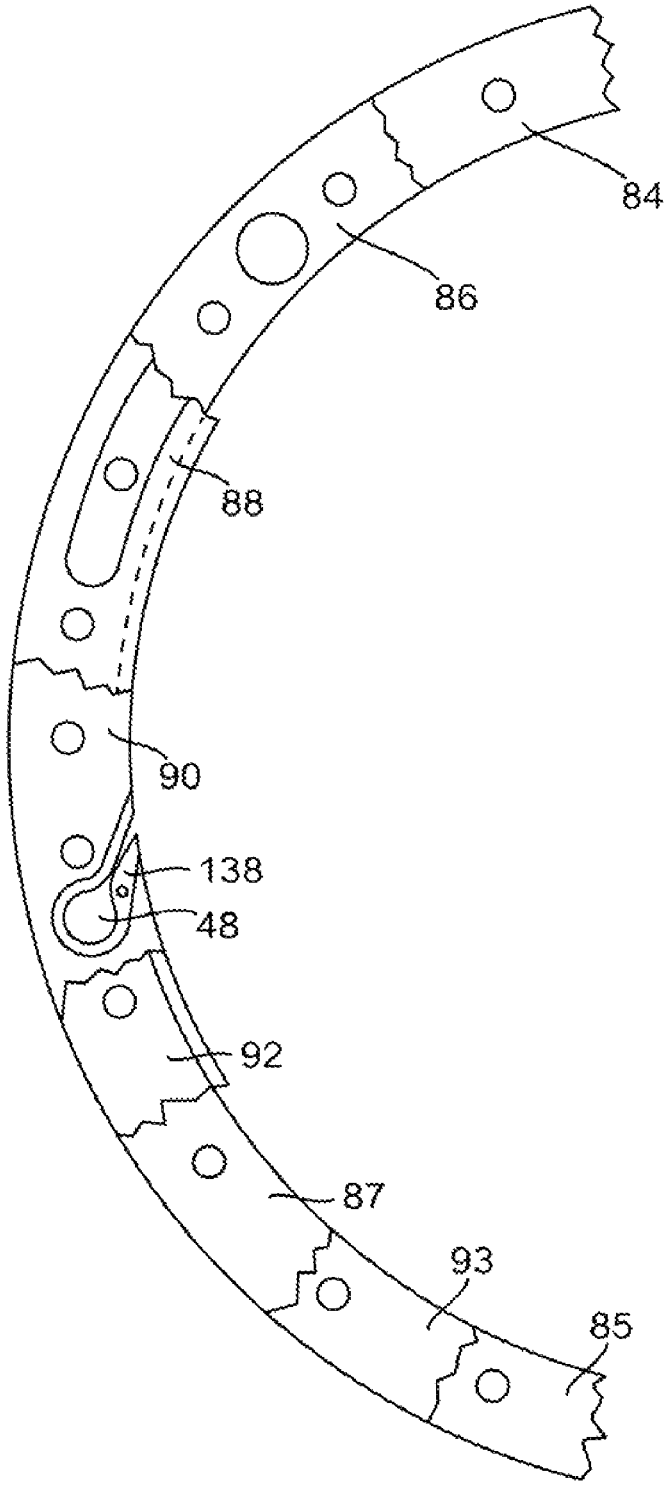
Figure 32:
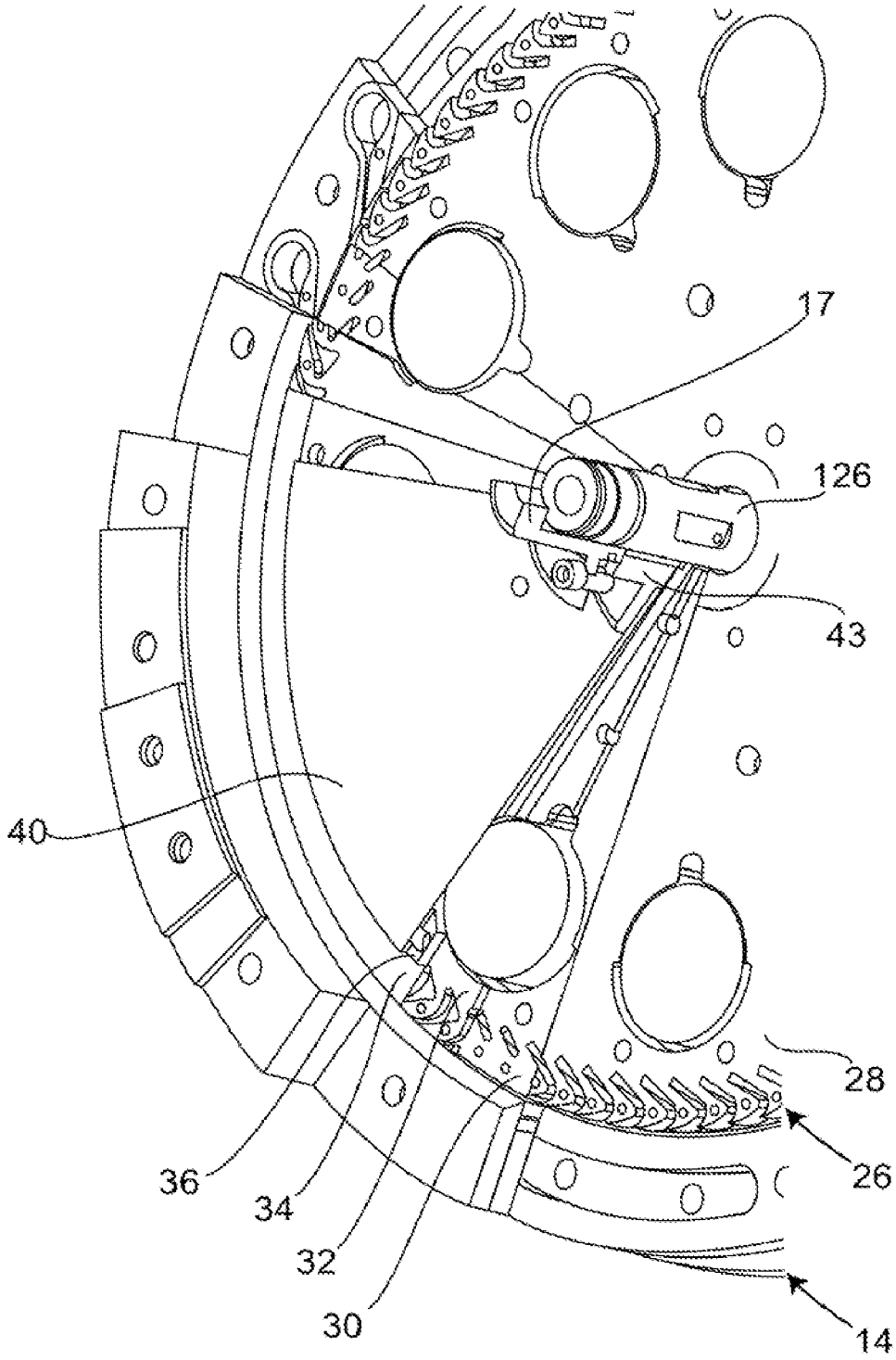
Figure 33:
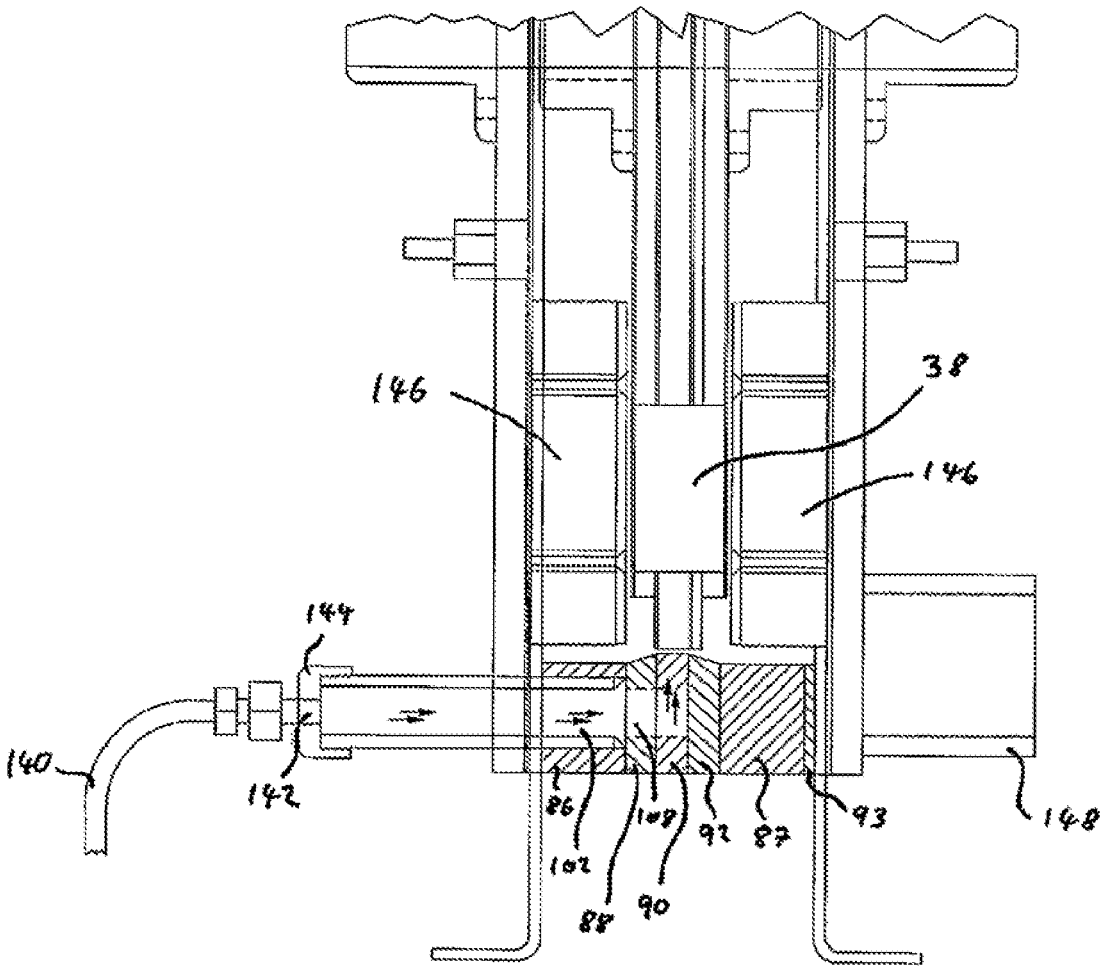
Figure 34:
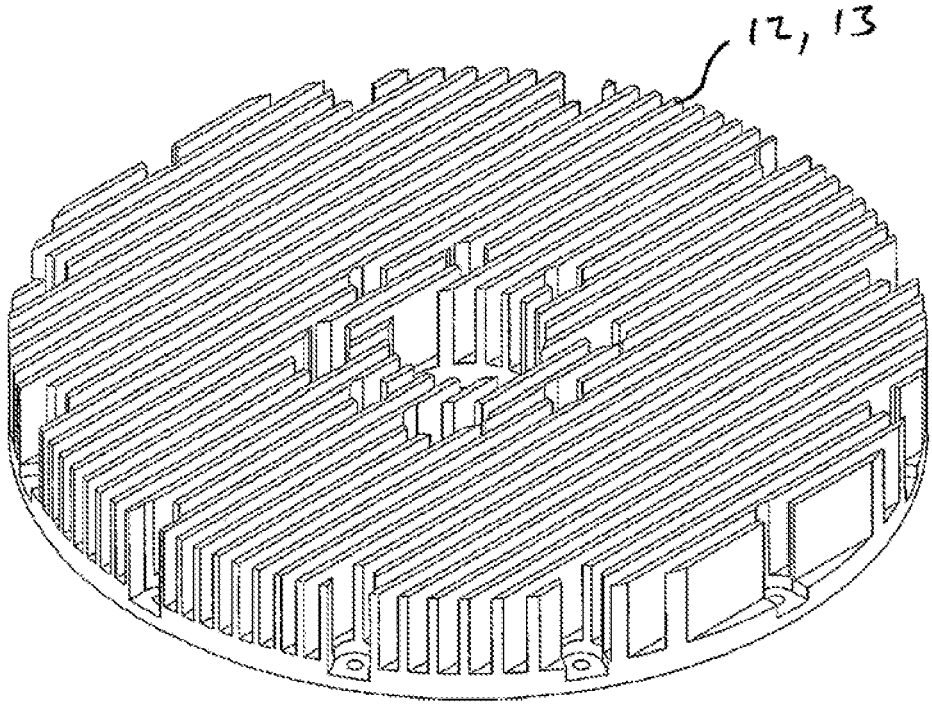
Figure 35:
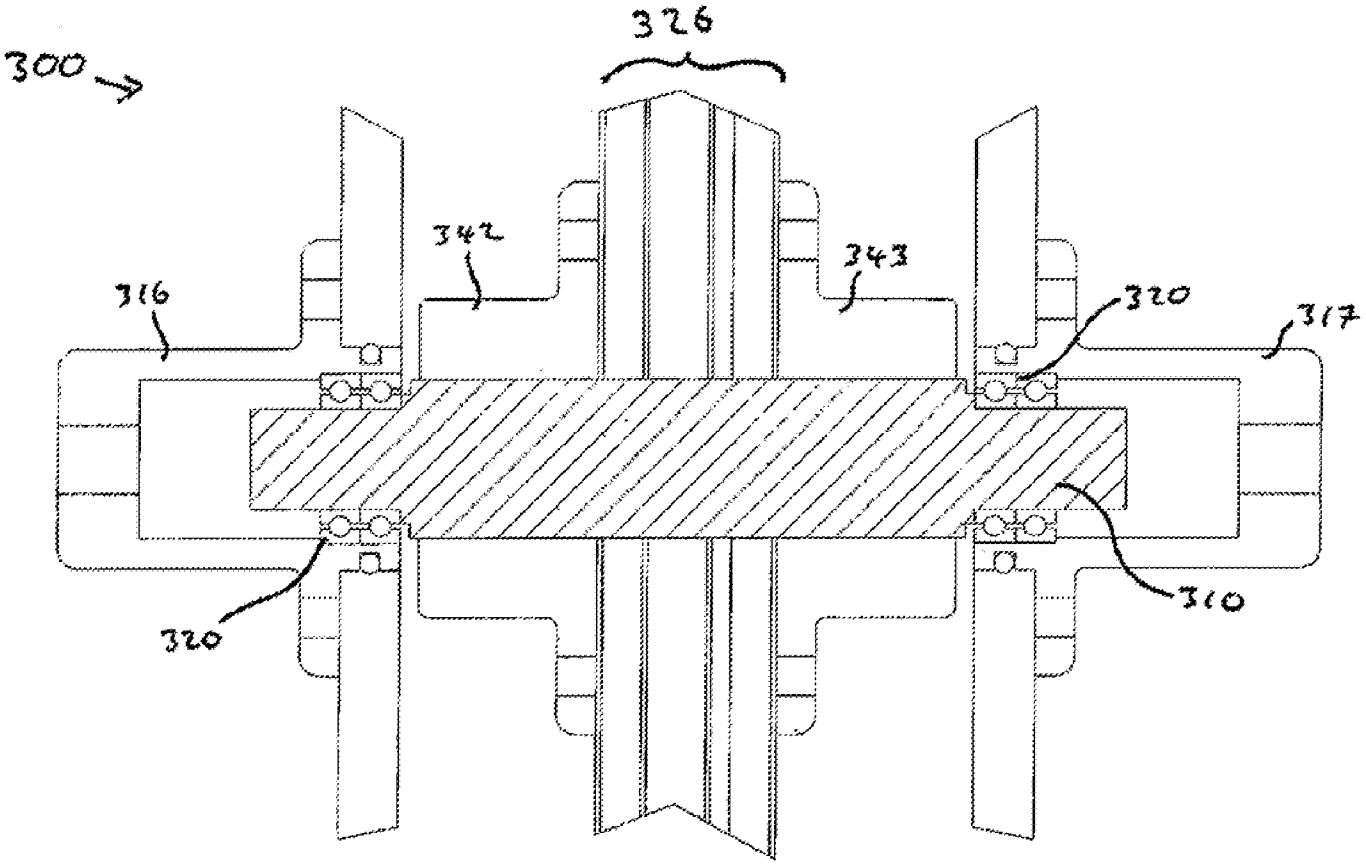
Figure 36:
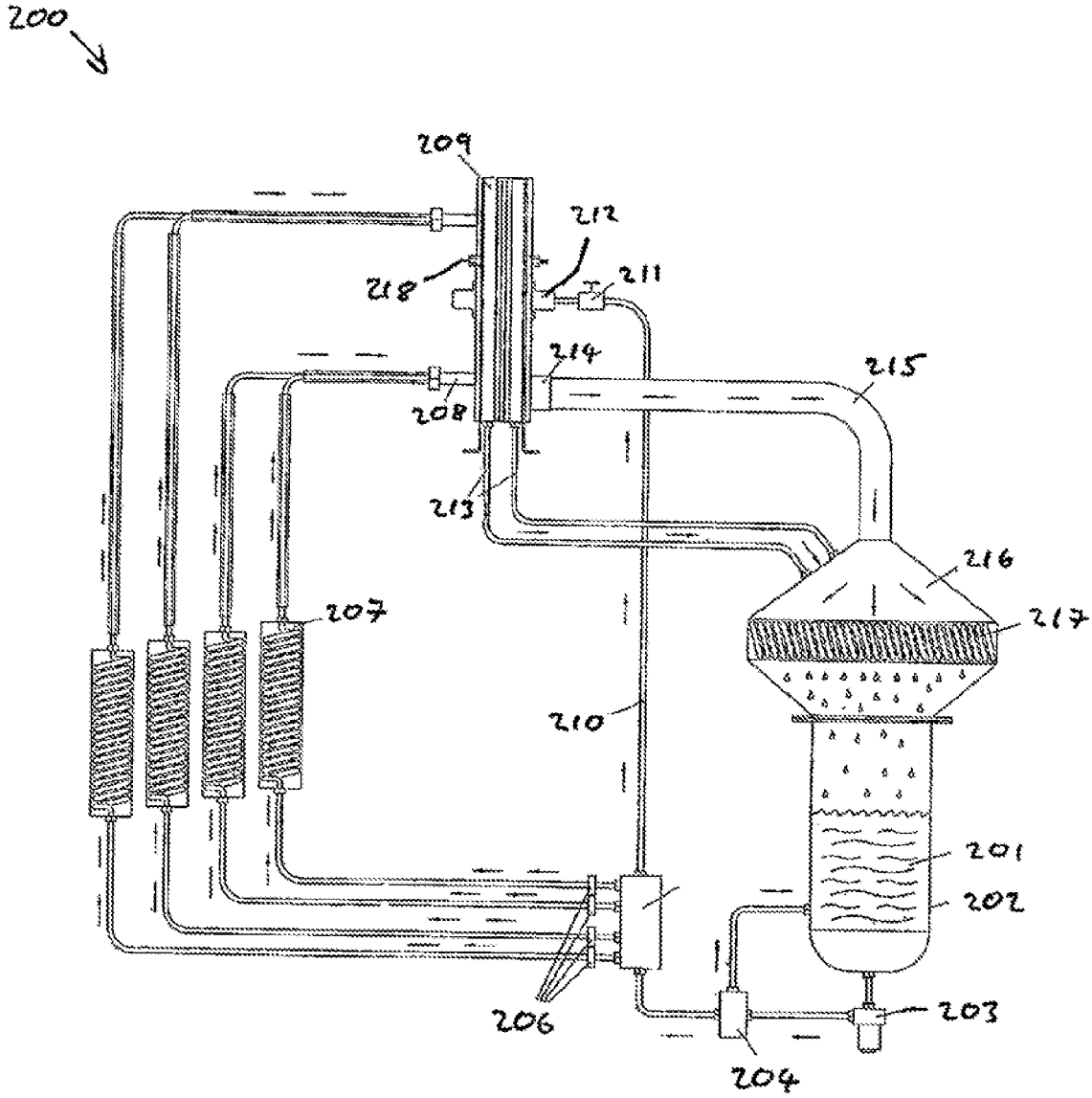

FIG. 6 is a perspective view of an impulse plate according to an aspect of the invention, FIG. 7 is a perspective view of a partition plate according to an aspect of the invention, FIG. 8 is a perspective view of a reaction plate according to an aspect of the invention, FIG. 9 is a perspective view of an end cap plate, FIG. 10 is a perspective view of a magnet location disc according to an aspect of the invention, FIG. 11 is an abstract view of an end cap disc, FIG. 12 is a perspective view of a rotor hub as used in the turbine generator of FIG. 1, FIG. 13 is a perspective view of an inlet side coil plate as used in the turbine generator of FIG. 1, FIG. 14 is a perspective view of an inlet side flux plate as used in the turbine generator of FIG. 1, FIG. 15 is a perspective view of a coil base plate as used in the turbine generator of FIG. 1, FIG. 16 is a perspective view of an inlet side leg stand ring as used in the turbine generator of FIG. 1, FIG. 17 is a perspective view of an inlet side spacer ring as used in the turbine generator of FIG. 1, FIG. 18 is a perspective view of a manifold as used in the turbine generator is of FIG. 1, FIG. 19 is a perspective view of a nozzle ring according to an aspect of the invention, FIG. 20 is a perspective view of a nozzle cap ring as used in the turbine generator of FIG. 1, FIG. 21 is a perspective view of the outlet side spacer ring as used in the turbine generator of FIG. 1, FIG. 22 is a perspective view of a compensation ring as used in the turbine generator of FIG. 1, FIG. 23 is a perspective view of an outlet side leg stand as used in the turbine generator of FIG. 1, FIG. 24 is a perspective view of an outlet side flux plate as used in the turbine generator of FIG. 1, FIG. 25 is a perspective view of an outlet side coil plate as used in the turbine generator of FIG. 1, FIG. 26 is a perspective view of a stationary hub as used in the turbine generator of FIG. 1, FIG. 27 is an exploded view of a stationary shaft and stationary hubs as used in the turbine generator of FIG. 1, FIG. 28 is a perspective view of rotor hubs as used in the turbine generator of FIG. 1 in alignment with each other, FIG. 29 is a partial perspective cutaway view of a portion of the generator of FIG. 1, FIG. 30 is a schematic view showing a portion of a nozzle ring assembly and a portion of a rotor according to aspects of the invention showing the directional change of a driving fluid directed towards the rotor, FIG. 31 is a partial cutaway view of a portion of the case of the turbine generator of FIG. 1 showing the various component layers of the case, FIG. 32 is a partial perspective cutaway view of a portion of the case of the turbine generator of FIG. 1 and a rotor of the turbine generator of FIG. 1 showing the various layers of those components, FIG. 33 is a partial side sectional view of a portion of the turbine generator of FIG. 1, FIG. 34 is a perspective view of a heat sink as used in the turbine generator of FIG. 1, FIG. 35 is a sectional view of a shaft of a modification to the turbine generator of FIG. 1; and FIG. 36 is a diagram of a system using a turbine generator according to FIG. 1.

FIG. 1 is a perspective view of the exterior of an exemplary turbine generator 10 according to the invention. Shown are: heat sinks 12, 13, a case 14, a stationary hub 16, inlet pipes 18*a*, 18*b*, 18*c*, and an expansion nozzle 20 (fitted to a further inlet). In practice, an expansion nozzle will also attach to each of the inlet pipes 18*a*, 18*b*, 18*c*.

The expansion nozzle 20 is preferably made from brass. The expansion nozzle 20 has a ¼" (0.64 cm) National Pipe Thread (NPT) inlet side and a ½" (1.28 cm) pipe outlet side. At the end of the inlet opening, the expansion nozzle 20 has an orifice (not shown). An expansion nozzle may be used when the driving fluid is a phase-change fluid. Under these circumstances the fluid may be supplied to the expansion nozzle as a pressurized liquid and the expansion may allow a drop in pressure thereby causing a phase change of the liquid to a gas, the gas then being used to drive the turbine. The dimensions and characteristics of the orifice may be determined by using standard engineering flow charts to determine the desired pressure and volume characteristics of the expansion nozzle 20 for a given system.

An on/off valve is attached to each expansion nozzle 20 (not shown). The on/off valve may be a manual valve or a solenoid valve, for controlling the flow through each expansion nozzle 20. Each expansion nozzle supplies 25% of the turbines nozzles, thus, the supply of fluid can be staggered in 25% increments by switching one or more nozzle on or off.

FIG. 2 is a perspective sectional view of the exemplary turbine generator 10 of FIG. 1. Shown are nickel-plated ⅜" (0.95 cm) carbon steel coil plates 22, 23 having coil sockets 24 for the mounting of generator coils (see FIG. 33). The heat sinks 12, 13 are attached to the coil plates 22, 23 to conduct heat out from the generator coils. Preferably, the heat sinks 12, 13 are made of aluminium. Also shown is a sectional view of a turbine rotor 26. Both the turbine rotor 26 and the case 14 of the turbine generator 10 comprise various concentric disks and rings, which may provide certain manufacturing and assembly benefits. For example, the use of multiple concentric disks may allow a rotor design with a fairly complex internal geometry to be built up from disks that are themselves more simple and easy to manufacture. In this specific example the disks are laser cut, but they could be manufactured by other methods for example CNC milled or cast.

The turbine rotor 26 is comprised of a single ⅜" (0.95 cm) aluminium impulse bucket disk 28, a 0.030" stainless steel slotted disk 30, and a ⅛" (0.32 cm) aluminium reaction thrust disk 32, 0.030" stainless steel cap disks 34, 35, ¼" aluminium magnet cradle disks 36, 37, and external disks 40, 41. The magnet cradle disks 36, 37 are not as large in circumference as the other disks 28, 30, 32, 34, 35 of the turbine rotor 26.

The turbine rotor 26 of the exemplary turbine generator 10 is 15" (38 cm) in diameter, but one of skill in the art will understand that all of the dimensions referenced herein are only exemplary as the spirit and scope of the invention is independent of any particular scale. For example, a turbine generator that uses pressurized steam as a driving fluid may well have a rotor that is several yards or meters in diameter, and a high power output turbine generator using a phase-change fluid may have a rotor of between 3 and 4 feet (90-120 cm) in diameter. For low power applications, for example for domestic heat recovery, the rotor diameter may be reduced to, for example 12" (30 cm).

The magnet cradle disks (or magnet location disks) 36, 37 help to create the thickness in the turbine rotor 26 to receive one inch (2.54 cm) thick, two inch (5.08 cm) diameter neodymium iron boron (NdFeB) 50 megagauss (50 MGa) magnets 38. External to the turbine rotor 26 on both sides are two titanium external disks 40, 41.

Fastened to the turbine rotor 26 on each side in the centre is an aluminium rotor hub 42, 43. Aluminium is a preferred hub material as it is light, non-magnetic and relatively inexpensive. Each rotor hub 42, 43 bolts through eight communicating bolt holes all the way through the rotor hubs 42, 43. Four of the bolt holes are counter-sunk on each side and four of the bolt holes are threaded on each side so bolt heads are positioned in every other hole on each side. Pressed into the rotor hubs 42, 43 are graphaloid, carbon graphite bushings 44, 45. These carbon graphite bushings 44, 45 are press fit and line-bored for about a 0.001" (25.4 micrometers) clearance to a 1.0" (2.54 cm) diameter turned, ground, and polished tubular shaft (see FIG. 27) that does not rotate.

The turned, ground and polished shaft fits into the stationary hubs 16, 17 that are sealed with an O-ring (see FIG. 27). The shaft also has O-rings (see FIG. 27). Fluid is brought in externally through a ¼" (0.64 cm) NPT line to pressurize the shaft. The shaft has holes and relief pockets which provide fluid under pressure between the shaft and the carbon graphite bushing 44, 45 to providing a hydrodynamic bearing.

The fluid that goes into the hydrodynamic bearing comes from a 200 psi ($1.3793\times10^6$ Pa) liquid pressurized pump which draws the fluid from a reservoir. A needle valve is positioned at the inlet to the stationary hubs 16, 17 to reduce the flow. The same phase change fluid is used to lubricate as is used to drive the turbine rotor 26, but lubricating fluid does not pass through the phase change. The lubricating fluid comes out at the end of the carbon graphite bushings 44, 45. The pressure and flow of the fluid assists in centring the rotor 26. However, the rotor 26 is also centred by magnetic reaction with the generator coils, known as Lorentz back-torque drag. The carbon graphite bushings 44, 45 are, therefore, lubricated with the same fluid that is driving the turbine rotor 26, such that there is only one type of fluid inside the turbine generator 10. This eliminates the need to have rotary seals. The turbine rotor 26 runs full speed with the carbon graphite bushings 44, 45 being supported on a fluid hydrodynamic film.

The bushings 44, 45 may run for many years without trouble, thereby aiding longevity of the turbine generator 10.

FIG. 3 is a cut-away view of the turbine generator 10 showing the detail of the impulse bucket disk 28 and a nozzle ring 46. The nozzle ring 46 has a plurality of nozzles 48 positioned around its inner periphery. The impulse, bucket disk 28 has a plurality of impulse buckets 50 positioned around its outer periphery and a plurality of magnet receiving openings 52. In operation, the nozzles 48 direct pressurized phase change fluid into the impulse buckets 50.

FIG. 4 is a larger view of the nozzles 48 and the impulse buckets 50. The pressurized phase change fluid enters a nozzle 48 and is directed toward an impulse bucket 50, engaging the impulse bucket 50 with an impulse. The impulse imparts a rotary thrust on the impulse bucket disk 28.

FIG. 5*a* illustrates the flow path of the phase change fluid through the rotor 26. The impulse bucket 50 receives pressurized, high velocity phase change fluid in a radial in-flow fashion through an inlet in an impulse bucket chamber 51, as illustrated by a first arrow 54. The high velocity phase change fluid stream first causes an impulse as the impulse bucket chamber 51 causes an angle change of about 121 degrees, illustrated by second arrow 56 and third arrow 58. After this deflection, the phase change fluid stream is caused to move along an internal inclined ramp section 60. During the gas flow along the inclined ramp section 60, the high velocity phase change fluid stream is decelerated and may start to build pressure in a reaction thrust chamber 62 due to the fact that it is now flowing against centrifugal force, illustrated by fourth arrow 64, and fifth arrow 66.

FIG. 5*b* illustrates the fluid flow path through a rotor having a slightly different geometry of reaction chamber to that shown in FIG. 5*a*. The geometry may be altered in order to fine-tune the turbine in response to, for example, different driving fluids.

As the phase change fluid stream reaches the end of the internal ramp section 60, it flows into the reaction thrust chamber 62, illustrated at sixth arrow 68. The decelerated phase change fluid flow may then be subject to an outward centrifugal force, illustrated by seventh arrow 70. The shape of the reaction thrust chamber allows the pressurized phase change fluid to be reaccelerated out of the end of the portion of the reaction thrust chamber 62, causing a motivating jet thrust reaction to further power the turbine rotor 26, as illustrated by eighth arrow 72.

Better understanding of the multi-axis, multi-directional chambers that form part of the rotor may be gained by review of the individual disks that make up the turbine rotor 26 in the following figures.

FIG. 6 is a perspective view of the impulse bucket disk 28. The impulse buckets 50 are positioned around the periphery of the impulse bucket disk 28. A representative impulse bucket chamber 51 and internal inclined ramp section 60 are identified. The exemplary impulse bucket disk 28 is made of a single piece of ⅜" (0.95 cm) thick aluminium. The impulse buckets 50 are preferably milled into the outer edge of the impulse bucket disk 28. The number of impulse buckets 50 is determined by the circumference of the impulse bucket disk 28 and how many impulse buckets 50 will fit around the circumference while maintaining the width of the incline ramp section 60 as equal to or just slightly less than the width of the structural wall member, which should always be as thick or thicker than the ramp section 60 (see FIGS. 4 and 5).

Also shown is a plurality of magnet receiving openings 52. Each magnet is 2" (5.08 cm) in diameter and each magnet receiving opening 52 has a cushion receiving offset 74 facing the centre of the rotor that is ⅛" (0.32 cm) larger than the 2" (5.08 cm) diameter magnet. Additionally, each magnet receiving opening 52 also has a dowel-receiving notch 76 for receiving a rod (not shown) filled with fibreglass that is 1" (2.54 cm) long and has a ⅜" (0.95 cm) diameter. The actual external circumference of the rod overlaps the external dimension of the magnet by a few thousandths of an inch. This causes the magnet to be pressed outward. In the preferred embodiment, a piece of ⅛" (0.32 cm) thick Teflon™ is used to fill the cushion receiving offset 74 of the assembled turbine rotor 26.

To assemble the rotor 26 and magnets, the rotor 26 is assembled except for the external disks 40, 41 that provide the shield, the Teflon™ piece goes in, the magnet is pressed in by hand, then a fibreglass dowel rod is gently tapped into the dowel-receiving notch 76. The dowel has a small bevel at the end, to aid in assembly. Another rod is used to "tap" the dowel in place using a rubber mallet. Since the turbine rotor 26 is laminated, the Teflon™ piece prevents abrasion of the magnet by the various layers of the rotor 26, as the magnet is slung outward by centrifugal force. Several of the layers are stainless steel and have been offset in their dimension, 0.010"

(0.254 mm), so that they are below the surface of each magnet receiving opening, such that there is no contact between the stainless steel layers and the magnets.

FIG. 7 is a perspective view of the stainless steel slotted disk or partition disk 30. In the preferred embodiment, the slotted disk 30 is 0.030" (0.76 mm) thick and has slots 78 positioned to be in alignment with a top portion of each internal inclined ramp section 60 of each impulse bucket chamber 51 of the impulse bucket disk 28, to provide a communication hole between the impulse bucket disk 28 and the reaction thrust disk 32 (see FIG. 2 and FIG. 5).

FIG. 8 is a perspective view of the reaction thrust disk 32, which has a plurality of reaction chambers 62 formed along its periphery. Each reaction is chamber 62 aligns with a slot 78 of the slotted disk 30 for receiving phase change fluid that has travelled up the inclined ramp section 60 of an impulse bucket chamber 51 in the impulse bucket disk 28 (see FIG. 2 and FIG. 5). In the preferred embodiment, the reaction thrust disk 32 is made of ⅛" (0.32 cm) thick aluminium.

FIG. 9 is a perspective view of one of the cap disks 34, 35, which are identical. Each cap disk 34, 35 provides either a floor for the impulse bucket chambers 51 of the impulse bucket disk 28 or a roof for the reaction chambers 62 of the reaction thrust disk 32 (see FIG. 2). In the preferred embodiment, each cap disk 34, 35 is made of 0.030" (0.762 mm) thick stainless steel.

FIG. 10 is a perspective view of one of the magnet cradle disks 36, 37, which are also identical. Each magnet cradle disk 36, 37 adds thickness to the turbine rotor 26 to secure the magnets. In the preferred embodiment, each magnet cradle disk 36, 37 is made of ¼" (0.64 cm) thick aluminium.

FIG. 11 is a perspective view of one of the titanium disks 40, 41. Titanium was chosen for its non-magnetic interference or lack of magnetic interference. Titanium has good magnetic permeability, making it substantially invisible to the magnetic field so the force of the magnets penetrates the titanium disks 40, 41.

FIG. 12 is a perspective view of one of the rotor hubs 42, 43. In actual use, the rotor hubs 42, 43 may have either a frusto-conical centre section, or a cylindrical centre section (as shown). As mentioned above, the rotor hubs 42, 43 of the preferred embodiment are made of aluminium.

The various components of the turbine rotor 28 are attached together by fasteners, such as screws, through various fastener receiving openings present in FIG. 6 through FIG. 12. For example, as shown in FIGS. 4 and 5, the meat of each turbine impulse bucket 50 has a threaded screw hole 80 for a screw that provides additional structural attachment of the turbine rotor disk 28 to the slotted disk 30 (FIG. 7) and the reaction thrust disk 32 (FIG. 8), which adds rigidity and reduces fatigue from the impulses pulsing on each bucket, which might have a tendency to cause a fatigue failure. The geometric layout is from the centre reference point of the centre of this screw hole 80. The screw hole 80 receives a countersunk head screw. The disk members together form the impulse and reaction thrust chambers of the rotor 26.

Returning to FIG. 2, as mentioned earlier, the case 14 is composed of a number of concentric, layered elements. More specifically, the case 14 includes, heat sinks 12, 13, stationary hubs 16, 17, coil plates 22, 23, low reluctance flux plates 82, 83, leg stand rings 84, 85, spacer rings 86, 87, a manifold ring 88, a nozzle ring 90, a nozzle cap ring 92, and a compensation ring 93.

FIG. 13 is a perspective view of the inlet side coil plate 22. In the preferred embodiment, the coil plates 22, 23 are made of ⅜" (0.95 cm) thick carbon steel which has been nickel plated for corrosion prevention and good magnetic field propagation. A centre hole 94 opens into the inlet side stationary hub 16. Also present are two electrical wiring holes 96, 98, which are half-inch (1.27 cm) pipe threaded and accept pressure vessel lugs that bring electric current from the coils. Also shown is a plurality of J-shaped slots 100 to provide a relief for wires coming from the centres of each coil. The J-shaped slots 100 do not penetrate all the way through the plate 22. It is noted that the slots of the preferred embodiment are J-shaped for constructional reasons (to accommodate the assembly around a screw head). In other embodiments the slots may be other shapes, for example straight slots.

Also shown are phase change fluid holes 102 that align with the inlet pipes 18.

FIG. 14 is a perspective view of the inlet side low reluctance flux plate 82. Such a plate may provide more efficient generation of electricity by providing a better flux path or flux circuit. In the preferred embodiment, the low reluctance flux plates 82, 83 are made of two pieces of 0.025" (0.635 mm) thick silicon iron. The flux plates 82, 83 are bolted down to the ⅜" (0.95 cm) nickel or zinc plated carbon steel coil plates 22, 23 which also serve as a bulkhead pressure vessel (In the preferred embodiment spent driving fluid opens up into the generator section of the turbine and drains.). Shown is a plurality of coil receiving cut-outs 104 positioned in a circular pattern around the flux plate 82. Also shown are electrical wiring holes 96, 98 and phase change fluid holes 102. Magnetic flux comes out of the magnet and is attracted to the silicon iron and the underlying carbon steel but the flux plates 82, 83 provide a very, very low reluctance flux path for the magnetic field and therefore reduce eddy currents.

FIG. 15 is a perspective view of an exemplary coil base plate 106. The exemplary coil base are made from two pieces of 0.025" (0.635 mm) thick pieces of silicon iron are configured to mate with the coil receiving cut-outs 104 of the flux plates 82, 83 (FIG. 14) that provide continuity of the magnetic flux underneath the coil.

FIG. 16 is a perspective view of the inlet side leg stand ring 84. Shown are phase change fluid holes 102. "100 KW" is laser cut into the inlet side leg stand ring 84.

FIG. 17 is a perspective view of the inlet side spacer ring 86. In the preferred embodiment, the spacer rings 86, 87 are 1" (2.54 cm) thick and provide spacing for the coils. Shown are phase change fluid holes 102. A drain hole is provided in the bottom centre of each of the spacer rings 86, 87.

FIG. 18 is a perspective view of the manifold ring 88. The manifold ring 88 is subdivided into four sections 108, 110, 112, 114 that each pressurize a number of nozzles. Each section 108, 110, 112, 114 is fed by one of the phase change fluid holes 102 present in the inlet side coil plate 22, flux plate 82, leg stand ring 84, and spacer ring 86. Of course, one of skill in the art will recognize that the manifold ring could be divided into any number of sections, depending on how many nozzles you wish to power at any one time. In the preferred embodiment, the manifold ring is ⅜" (0.95 cm) thick, and has a bevelled inside edge 116 to provide a positive down hill slope from the edge of the turbine rotor to a drain hole in the bottom centre of the inlet side spacer ring 86.

FIG. 19 is a perspective view of the nozzle ring 90. A plurality of tear-shaped nozzles 118 are spaced along the inside edge of the nozzle ring 90. In the preferred embodiment, each manifold ring section 108, 110, 112, 114 (FIG. 18) pressurizes five nozzles 118. This allows each section 108, 110, 112, 114 and the corresponding nozzles 118 to be controlled separately, for instance in the event that not all four sections are desired or needed simultaneously.

FIG. 20 is a perspective view of the nozzle cap ring 92. In the preferred embodiment, the nozzle cap ring 92 is ⅜" (0.95 cm) thick and has a bevelled inside edge 120. The bevelled inside edge 120 tapers ⅛" (0.32 cm) away from the nozzle ring 90 to allow phase change fluid to escape from the reaction chambers 62 of the reaction thrust disk 32.

FIG. 21 is a perspective view of the outlet side spacer ring 87. Shown is a recess for forming a drain channel 122.

FIG. 22 is a perspective view of the compensation ring 93, which is added to the case 14 to compensate for the thickness of the reaction thrust disk 32 on the outlet side of the case 14. Shown is a recess for forming a drain channel 122.

FIG. 23 is a perspective view of the outlet side leg stand ring 85. Shown is a recess for forming a drain channel 122.

FIG. 24 is a perspective view of the outlet side low reluctance flux plate 83. The outlet flux plate has similar construction to the inlet side flux plate 82, including electrical wiring holes 96, 98 and coil-receiving cut-outs 104. Also shown is a drain hole 124.

FIG. 25 is a perspective view of the outlet side coil plate 23. The outlet side coil plate 23 has similar construction to the inlet side flux plate 22, and includes a drain hole 124.

FIG. 26 is a perspective view of one of the stationary hubs 16, 17. In the preferred embodiment, the stationary hubs 16, 17 are secured by eight bolt holes. Threads to receive bolts are in the coil plates 22, 23. The stationary hubs 16, 17 have an interior recess (see FIG. 27) that will receive a 1" (2.54 cm) turn ground and polished shaft. The shaft has an O-ring and a 0.50" (1.27 cm) diameter centre bore. The stationary hubs 16, 17 will be threaded with a quarter inch (0.635 cm) pipe tap. One hub will have a pressure gauge and the other hub will have a pipe fitting for a metal pipe to bring the phase change fluid in from a pressurized boost pump.

FIG. 27 is an exploded view of a stationary shaft 126 and the stationary hubs 16, 17. The stationary shaft 126 is turned, ground and polished, and is non-magnetic and hollow. In the preferred embodiment, the shaft 126 has eight weep holes 128 from the inside to the outside in the regions that align with the carbon graphite bushings 44, 45 (see FIG. 2) of the rotor hubs 42, 43. Additionally, the stationary shaft 126 also has pockets or recesses 130 in the outer surface of the stationary shaft 126. Still further, the stationary shaft 126 is fitted with "O" rings 132, 133 on each end, which are received within and held by the stationary hubs 16, 17. The "O" rings 132, 133 provide a fluid tight seal between the inner surface of the stationary hubs 16, 17 and the outer surface of the stationary shaft 126. The stationary shaft 126 also has set screw receiving grooves 134, 135 that cooperate with set screws (not shown) and threaded, set screw receiving holes 136, 137 in the stationary hubs 16, 17.

FIG. 28 is a perspective view of the rotor hubs 42, 43 in alignment with each other and in proportion to the stationary shaft 126 and the stationary hubs 16, 17 of FIG. 27. The turbine rotor 26 (see FIG. 2) is mounted on the rotor hubs 42, 43, which are fitted with carbon graphite bushings 44, 45.

In operation, the stationary shaft 126 and "O" rings 132, 133 create a non-wearing sealing system with no moving parts requiring replacement or frictional heat and loss of efficiency. Pressurized phase change fluid from the interior of the stationary shaft 126 flows through the holes 128 into the pockets 130 and, then, into the clearance between the shaft and the carbon graphite bushings 44, 45 forming a hydrodynamic bearing in which the bushings 44, 45 are no longer in direct contact with the stationary shaft 126. This eliminates wear and provides cooling for the inside of the whole unit, including the generator induction coils (see FIG. 33). The phase change fluid exits the outside ends of the bushings 44, 45 and is slung out into the case 14 in a 360 degree spray pattern. This starts the condensation process on the vapour coming into the housing from the rotor 26 and assists in keeping the turbine rotor centred as to side to side thrust loads. The liquid gathers on the inside of the housing outer wails and runs down into a liquid drain sump that is located on the bottom of the case 14 on each side of the rotor and is provided.

FIG. 29 is a partial perspective cut-away view of a portion of the case 14 and rotor 26. Shown are nozzle inserts 138 received within the nozzles 48. Nozzle inserts 138 allow for testing, setup and for tuning, and may be attached to the nozzle ring by means of attachment screws 139. Every application is different, so a rapid means for tuning the nozzle geometry for a specific application, for example tuning relative to the amount of heat and the gallons per minute of flow, is needed. The case 14 can be partially disassembled in order to expose the nozzle ring 90 and change the nozzle inserts 138 to where they have the desired characteristics. Through trial and error or through virtual reality computational fluid dynamics, the right type of nozzle can be determined. Presently, the nozzle inserts 138 are made of laminate layers to allow very narrow exit passages to be accomplished. Ultimately, however, nozzle inserts 138 that are cut by wire-EDM in one piece from the same stock as the nozzle ring 90 may be advantageous.

FIG. 30 is a partial cut-away of the nozzle ring 90, a nozzle 48 with a nozzle insert 138, and the impulse bucket disk 28 showing the vector change of the high pressure phase change fluid as it exits the nozzle insert 138, enters the impulse bucket chamber 51 imparting a rotational impulse on the impulse bucket disk 28, and is redirected up the internal inclined ramp section 60.

FIG. 31 is a partial cut-away view of a portion of the case 14, showing the layers of case rings, including a leg stand ring 84, a spacer ring 86, a manifold ring 88, a nozzle ring 90, a nozzle cap ring 92, a spacer ring 87, a compensation ring 93, and a leg stand ring 85. Also shown is a nozzle insert 138 in a nozzle 48 of the nozzle ring 90.

FIG. 32 is a partial perspective cut-away of a portion of the case 14 and the turbine rotor 26 showing, in particular, the layers of the rotor disks, including the impulse bucket disk 28, the slotted disk 30, the reaction thrust disk 32, the cap disk 34, the magnet cradle disk 36, and the titanium external disk 40. Also shown are the rotor hub 43, the stationary hub 17, and the stationary shaft 126.

FIG. 33 is a partial side sectional view of the bottom one half of the turbine generator 10. The case 14 comprises a number of rings of varying thickness that have cutouts and holes to provide for the function of the device. The left hand side is designated the inlet side and the right hand side is the exhaust side. The spacer ring 86 is 1" (2.54 cm) thick and has four phase change fluid holes 102 (only one is shown) that are ninety degrees to each other that are large enough to receive the end of a 3" (7.62 cm) long piece of ½" (1.27 cm) NPT stainless steel inlet pipe 18 (only one is shown) which is welded in a recessed fashion in the end of each hole. These pipes 18 form expansion chambers that convert hot pressurized fluid into a high pressure gas to power the turbine. The fluid is carried by a line 140 and through an expansion fitting 142 that is screwed into an adapter cap 144 that screws onto the end of the inlet pipe 18. The phase change fluid holes 102 open into the one of the nozzle manifold ring sections 108, 110, 112, 114 of the manifold ring 88. Each of the nozzle manifold ring sections 108, 110, 112, 114 overlays five nozzles 48, preferably with nozzle ring inserts 138 (see FIG. 29). Also shown are generator induction coils 146, a magnet 38, and a drain pipe 148.

FIG. 34 is a perspective view of one of the heat sinks 12, 13.

A second embodiment of a turbine generator 300 according to the invention is illustrated in FIG. 35. This generator is identical to the first embodiment described above with the difference that a rotating shaft having contact bearings has replaced the static shaft having a hydrodynamic bearing described in the first embodiment.

A rotating shaft 310 is affixed to the turbine rotor hubs 342,343 by means of a press fit so that a rotor 326 and the shaft turn as one unit. Dual-row angular contact bearings 320 are then fitted to the ends of said shaft on a turned down section that, with spacer shims, defines the location of the rotor in the centre of the unit. The rotor is identical to the rotor 26 described above. The outer hubs 316, 317 both have a bore that receives the dual-row angular contact bearings on their outside diameter surface as is standard practice in the art. Additional spacing shims can be used under the flange of the outside hubs for proper set up and fit. The outside hubs also can be fitted with grease fittings or oil lubrication to supply the bearings with proper lubrication.

Lastly, FIG. 36 is a diagram of a waste heat recovery turbine generator system 200. A phase change heat transfer liquid 201 is drawn from a reservoir 202 and pressurized by an electrically driven pump 203. This pump discharge is then routed by high pressure tubing through a pressure bypass valve 204 to a solenoid control unit 205 where solenoid valves 206 can be independently opened and the fluid routed to a waste heat exchanger section 207. When the fluid exits the heat exchangers it then passes through insulated tubing to any or all of expansion chambers 208 that enter into a turbine generator 209. A line 210 runs from the solenoid controlled unit 205 and by-passes the waste heat exchanger section 207 and runs to a needle valve 211 where the flow rate is restricted and passes into the end of the external hub 212. The external hub 212 is mounted on the centre of a stator end disk, which carries generator induction coils and serves as a pressure bulkhead for the turbine generator 209. A main exhaust 214 is located on the right side of the turbine generator 209 at a level even with the bottom of a drain channel in the bottom of the case which forms a sump. The vapour then flows out of the case through an exhaust pipe 215 into an expansion chamber 216 where it is further cooled. Additionally, return lines 213 are provided on each side of the rotor which also return fluid (from hydro-dynamic bearings) to the expansion chamber 216. The cooling vapour then passes through the condenser 217, where it is cooled below its dew point and returns to a liquid and falls into the reservoir thus completing a closed loop cycle. Two insulated terminals 218 bring electric power from inside the pressure vessel to the outside for use.

One of ordinary skill in the art will recognize that additional configurations are possible without departing from the teachings of the invention. This detailed description, and particularly the specific details of the exemplary embodiments is disclosed, is given primarily for clearness of understanding and no unnecessary limitations are to be understood therefrom, for modifications will become obvious to those skilled in the art upon reading this disclosure and may be made without departing from the spirit or scope of the invention.

The invention claimed is:

1. A nozzle ring assembly for supplying driving fluid to a rotor of a radial flow turbine, the assembly comprising;

a ring having an inner surface for encircling the rotor, a plurality of nozzles distributed around the ring, each having an outlet defined in the inner surface of the ring, and a fluid inlet for supplying high pressure fluid to each nozzle;

wherein each nozzle is defined in a removable insert seatable in the ring such that the nozzle outlet opens through the inner surface of the ring.

2. A nozzle ring assembly according to claim 1 further comprising a manifold whereby a single fluid inlet supplies a plurality of nozzles.

3. A nozzle ring assembly according to claim 1 in which the fluid inlet supplies fluid to the nozzle in an axial direction relative to the ring, and the nozzle redirects the fluid into a radial plane, to emerge through the inner surface of the ring.

4. A nozzle ring assembly according to claim 1 in which the fluid inlet comprises an expansion nozzle.

5. A nozzle ring assembly according to claim 1 in which the fluid is a phase change fluid.

6. A radial-flow turbine comprising a nozzle ring assembly according to claim 1.

7. A radial flow turbine according to claim 6 additionally comprising magnets and a coil assembly for generating electricity.

8. A radial flow turbine according to claim 7 in which the coil assembly comprises a plurality of copper wire coils each wound onto a core of a non-magnetic material, for example nylon.

9. A radial flow turbine according to claim 7 further comprising a plate of low reluctance material mounted behind the coil assembly for providing a flux path for a magnetic field.

10. A system for generating electricity from waste heat comprising a heat exchanger containing a fluid for extracting waste heat, and a turbine according to claim 7, the turbine being drivable by the fluid.

11. A system according to claim 10 further comprising a condenser and a pump.

* * * * *